US010610434B2

(12) United States Patent
Sabota et al.

(10) Patent No.: US 10,610,434 B2
(45) Date of Patent: Apr. 7, 2020

(54) INFANT MEDICAL DEVICE AND METHOD OF USE

(71) Applicant: Segars California Partners, LP, Austin, TX (US)

(72) Inventors: Peter Sabota, Austin, TX (US); Christopher Lynn, Austin, TX (US)

( * ) Notice: Subject to any disclaimer, the term of this patent is extended or adjusted under 35 U.S.C. 154(b) by 17 days.

(21) Appl. No.: 15/266,803

(22) Filed: Sep. 15, 2016

(65) Prior Publication Data

US 2018/0071160 A1 Mar. 15, 2018

(51) Int. Cl.
*A61G 11/00* (2006.01)

(52) U.S. Cl.
CPC ..... *A61G 11/00* (2013.01); *A61G 2203/46* (2013.01)

(58) Field of Classification Search
CPC .. A61G 11/00; A61G 11/003; A61G 2203/46; F21V 7/09; F21V 5/08
See application file for complete search history.

(56) References Cited

U.S. PATENT DOCUMENTS 1,235,275 A * 7/1917 Wood ..... F21V 7/06 362/298
1,776,863 A 9/1930 Maxson
1,817,027 A 8/1931 Anderson
2,257,366 A 9/1941 Bates et al.
2,384,670 A 9/1945 Fisher et al.
2,535,268 A 12/1950 Coats
2,681,061 A 6/1954 Modell
3,461,275 A 8/1969 Poole
3,511,983 A 5/1970 Dorman
3,585,390 A 6/1971 Ishikawa
3,959,660 A 5/1976 Tolliver
4,731,714 A 3/1988 Kelly et al.
4,809,677 A 3/1989 Mackin et al.
4,816,974 A 3/1989 Gordin
4,832,029 A 5/1989 Koch et al.
5,474,517 A 12/1995 Falk et al.
5,666,017 A 9/1997 McGuire
5,830,123 A 11/1998 Franz et al.
5,841,944 A 11/1998 Hutchinson et al.
5,915,072 A 6/1999 Campbell et al.
5,989,283 A 11/1999 Wilkens
6,155,970 A 12/2000 Dykes et al.
6,245,010 B1 * 6/2001 Jones ..... A61G 11/00 600/22
6,382,803 B1 * 5/2002 Arumugasaamy ..... F21V 7/09 359/850
D770,082 S * 10/2016 Reynolds ..... D26/118
(Continued)

FOREIGN PATENT DOCUMENTS

BE 785969 B1 11/1972
DE 3127707 A1 2/1983
EP 332668 B1 5/2002

*Primary Examiner* — Kaylee R Wilson
(74) *Attorney, Agent, or Firm* — Barnes & Thornburg LLP

(57) ABSTRACT

A medical device including a patient support and a radiant heater positioned above the patient support is disclosed. The radiant heater includes a reflector that partially surrounds a heating element. The reflector includes a plurality of layers of customized facets to direct radiant energy emitted by the heating element toward a predefined region of the patient support to maintain the predefined region at a predetermined temperature.

20 Claims, 18 Drawing Sheets

(56) References Cited

U.S. PATENT DOCUMENTS

| | | | | |
|---|---|---|---|---|
| 2004/0082829 | A1* | 4/2004 | Mackin | A61F 7/00 600/22 |
| 2009/0231856 | A1* | 9/2009 | Householder | F21V 7/0025 362/304 |
| 2013/0310634 | A1* | 11/2013 | Matsubara | A61G 11/009 600/22 |
| 2015/0066117 | A1* | 3/2015 | Koch | A61G 11/00 607/100 |

* cited by examiner

| LAYER | ANGLE $\beta$ (DEGREES) | DISTANCE 210 ( INCHES ) | DISTANCE 212 (INCHES ) | DISTANCE 214 (INCHES ) |
|---|---|---|---|---|
| 148 | 15 | 4.750 | 4.900 | 4.225 |
| 188 | 15 | 4.485 | 4.650 | 4.090 |
| 218 | 15 | 4.225 | 4.375 | 3.900 |
| 220 | 15 | 3.900 | 4.075 | 3.675 |
| 224 | 15 | 3.525 | 3.725 | 3.435 |
| 226 | 15 | 3.225 | 3.450 | 3.140 |
| 228 | 15 | 2.875 | 2.950 | 2.825 |
| 230 | 15 | 2.475 | 2.475 | 2.475 |
| 232 | 15 | 1.950 | 1.950 | 1.950 |
| 234 | 15 | 1.1155 | 1.1155 | 1.1155 |

INFANT MEDICAL DEVICE AND METHOD OF USE

TECHNICAL FIELD

The present disclosure relates generally to medical devices and equipment and, more specifically, to medical devices such as incubators, infant radiant warmers, and other devices for use in neonatal care.

BACKGROUND

Hospitals and other medical providers offering neonatal care use a variety of medical devices to care for infants after delivery. Those medical devices include incubators, infant radiant warmers, and other devices that can function both as incubators and radiant warmers, which include a mattress or other patient's support on which an infant may be placed. A typical infant radiant warmer also includes a heating element that is intended to be placed over an infant to maintain the infant's body temperature by means of radiant heat. The heating element may be an infrared heating element. An infant radiant warmer may also include a reflector positioned above the heating element to direct radiant energy toward the mattress. A description of infant radiant warmers is set forth in 21 C.F.R. § 880.5130 (1997). A voluntary standard 60601-2-21 for infant radiant warmers has been published by the Association for the Advancement of Medical Instrumentation (AAMI), which outlines various requirements for infant radiant warmers.

SUMMARY

According to one aspect, a medical device for infant care is disclosed. The medical device may be an infant radiant warmer. The medical device comprises a patient support sized to receive a body of an infant, and a radiant heater positioned above the patient support. The radiant heater comprises an infrared heating element operable to emit radiant energy, and a reflector that partially surrounds the infrared heating element. The reflector includes a plurality of customized facets to direct radiant energy emitted by the infrared heating element toward a predefined region of the patient support to maintain the predefined region at a predetermined temperature. In some embodiments, each customized facet includes a substantially planar inner surface.

In some embodiments, the reflector may include an outer rim, a first customized facet positioned opposite the outer rim, and a number of layers of customized facets positioned between the first customized facet and the outer rim. Additionally, the first customized facet may include a planar inner surface. In some embodiments, the heating element may be secured to the first customized facet.

Additionally, in some embodiments, each layer of customized facets may have the same height. In some embodiments, each layer of customized facets may include the same number of facets. It should be appreciated that each customized facet of each layer of customized facets may intersect an adjacent customized facet of the layer along a substantially straight line. In some embodiments, each customized facet of each layer of customized facets may intersect a customized facet of another layer along a substantially straight line.

In some embodiments, the number of layers of customized facets may include a first layer, and each customized facet of the first layer may intersect the first customized facet along a curved line. Additionally, in some embodiments, each customized facet of the first layer may intersect an adjacent customized facet of the first layer along a substantially straight line.

The number of layers of customized facets may include a second layer. The first layer of customized facets may be positioned between the first customized facet and the second layer. In some embodiments, each customized facet of the second layer may intersect a customized facet of the first layer along a substantially straight line. Additionally, in some embodiments, each customized facet of the second layer may intersect an adjacent customized facet of the first layer along a substantially straight line.

The medical device may also comprise a frame connecting the radiant heater to the patient support. The frame may include a vertical arm that supports the radiant heater above the patient support. An angle may be defined between the vertical arm and the patient support that has a magnitude in a range between 89 degrees and 93.5 degrees.

In some embodiments, an angle may be defined between a plane defined by the outer rim and a horizontal plane. The angle may have a magnitude in a range between 19.5 degrees and 24 degrees. In some embodiments, a vertical distance may be defined between a lower section of the reflector and the patient support. The vertical distance may be in a range of 29 and 34 inches.

According to another aspect, a medical device comprising a patient support and a radiant heater positioned above the patient support is disclosed. The radiant heater comprises a reflector that partially surrounds a heating element, and the reflector includes a plurality of layers of customized facets to direct radiant energy emitted by the heating element toward a predefined region of the patient support to maintain the predefined region at a predetermined temperature. Each customized facet of each layer of customized facets intersects an adjacent customized facet of the layer along a substantially straight line, and each customized facet of each layer of customized facets intersects a customized facet of another layer along a substantially straight line.

In some embodiments, each layer of customized facets may have the same height. Each layer of customized facets may include the same number of facets.

In some embodiments, the reflector may include a base configured to receive the heating element, and the number of layers of customized facets may include a first layer. Each customized facet of the first layer may intersect the base along a curved line.

According to another aspect, a medical device comprises a radiant heater configured to be positioned above a patient support at a predetermined orientation and position. The radiant heater comprises an infrared heating element operable to emit radiant energy, and a reflector including a plurality of annular layers that partially surround the infrared heating element. Each annular layer includes a plurality of facets having customized shapes and customized positions relative to the infrared heating element. The facets of each layer intersect adjacent facets along substantially straight lines, and each facet of each layer intersects a facet of another layer along a substantially straight line. Each facet has a substantially planar inner surface.

BRIEF DESCRIPTION OF THE DRAWINGS

The detailed description particularly refers to the following figures, in which.

DETAILED DESCRIPTION OF THE DRAWINGS

Figure 1:
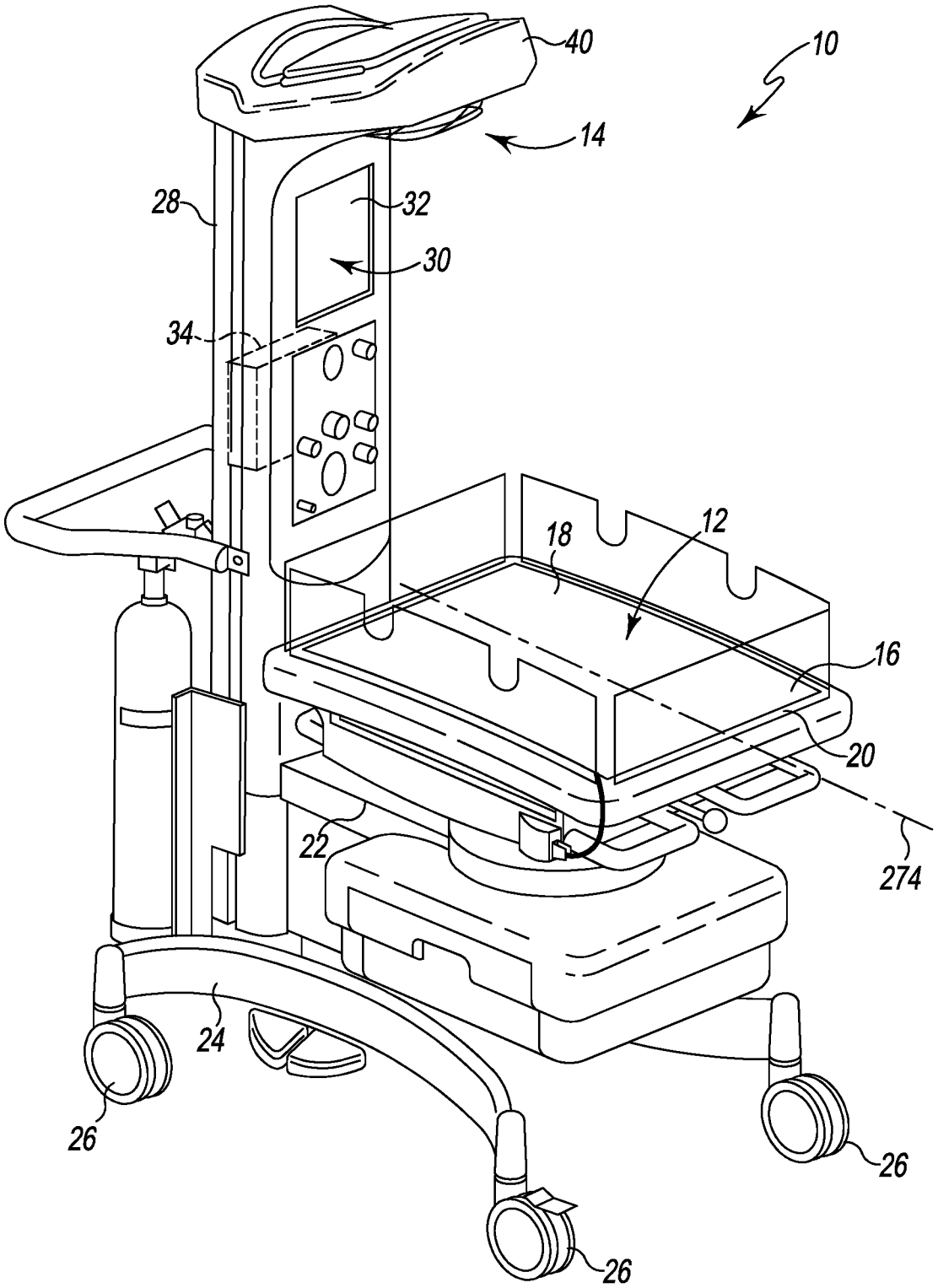
FIG. 1 is a perspective illustrating an infant medical device for use in neonatal care.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, a medical device 10 for use in neonatal care is shown. The medical device 10 is embodied as an infant radiant warmer that includes a patient support 12 sized to receive an infant. The radiant warmer 10 also includes a radiant heater 14 that is positioned above the patient support 12, which is sized and positioned to direct radiant energy to the patient support 12. As described in greater detail below, the radiant heater 14, when energized, directs sufficient radiant energy to the patient support 12 to heat the patient support and maintain at least a portion of the patient support at a predetermined temperature.

In the illustrative embodiment, the patient support 12 includes a mattress 16 having a substantially planar upper surface 18. The mattress 16 is positioned in a tray 20 of the patient support 12. As shown in FIG. 1, the patient support 12 is mounted on a cantilevered arm 22 that is attached a lower frame 24. The lower frame 24 includes a number of casters 26 to permit movement of the radiant warmer 10.

Figure 2:
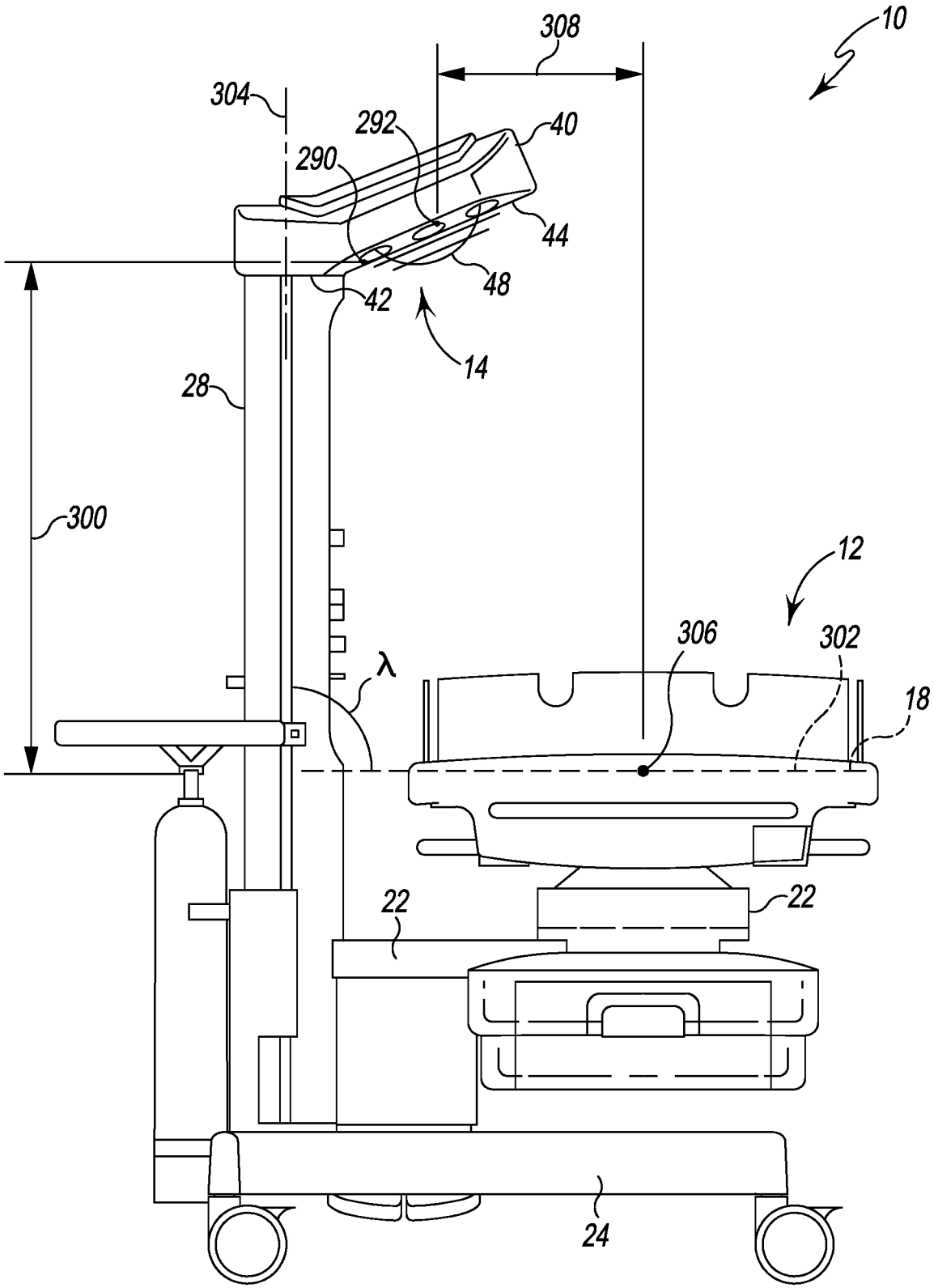
FIG. 2 is an elevation view illustrating the infant medical device of FIG. 1.

A vertical support arm or column 28 extends upwardly from the lower frame 24 and the cantilevered arm 22. The radiant warmer 10 includes a control panel 30 that is mounted on the support column 28. The control panel 30 includes a user interface 32, which is illustratively embodied as a touchscreen, that a caregiver may use to control various features of the radiant warmer 10, including the heater 14. Electrical circuitry 34, including microprocessors and other electronic hardware, is positioned in the support column 28. The electrical circuitry 34 is configured to, among other things, receive input signals from user interface 32 and transmit control signals to provide power to energize the heater 14. As shown in FIG. 2, the support column 28 has an upper housing 40 that extends outwardly from its upper end 42. In the illustrative embodiment, the radiant heater 14 is positioned in the upper housing 40.

Figure 3:
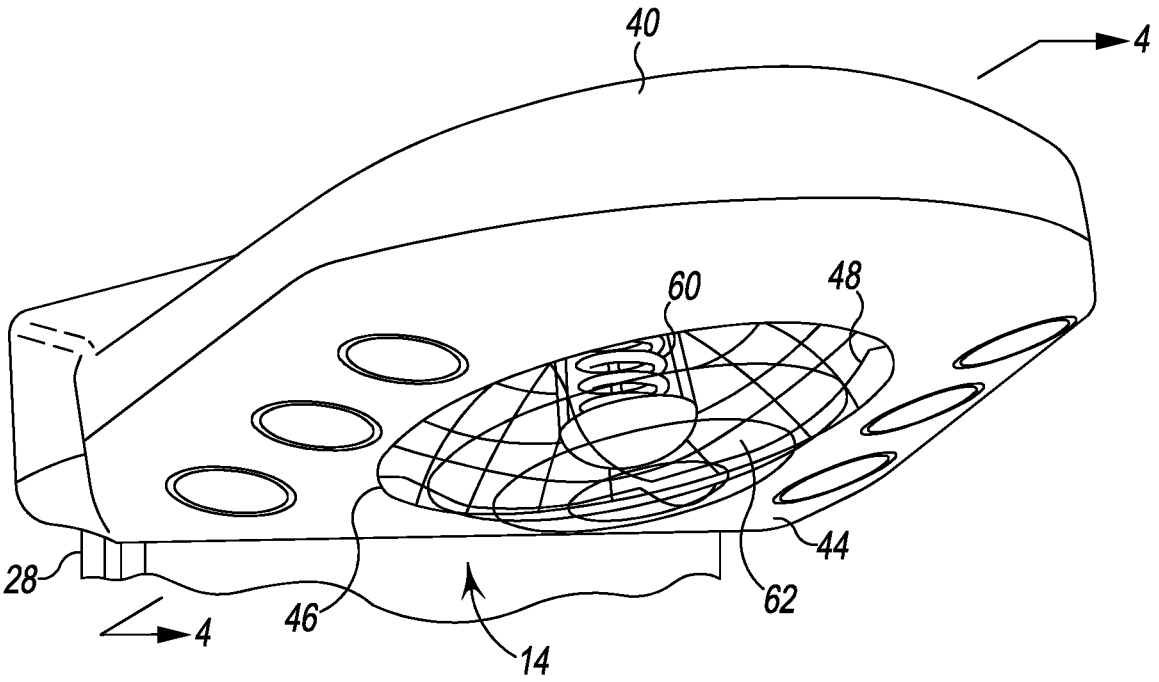
FIG. 3 is a perspective view illustrating a heater head of the infant medical device of FIGS. 1-2.

Referring now to FIG. 3, the upper housing 40 has a lower surface 44 that faces toward the patient support 12 positioned below. An opening 46 is defined in the lower surface 44, and the radiant heater 14 is visible through that opening 46. A protective grille 48 is positioned over the opening 46 to prevent inadvertent contact with the radiant heater 14. To provide radiant energy to the patient support 12, the heater 14 includes a heating element 60 and a reflector 62 that partially surrounds the heating element 60. As described in greater detail below, the reflector 62 includes a plurality of customized facets that are sized and positioned to direct radiant energy emitted by the heating element 60 toward the patient support 12 to heat the patient support and maintain a predefined region of the patient support at a predetermined temperature.

Figure 4:
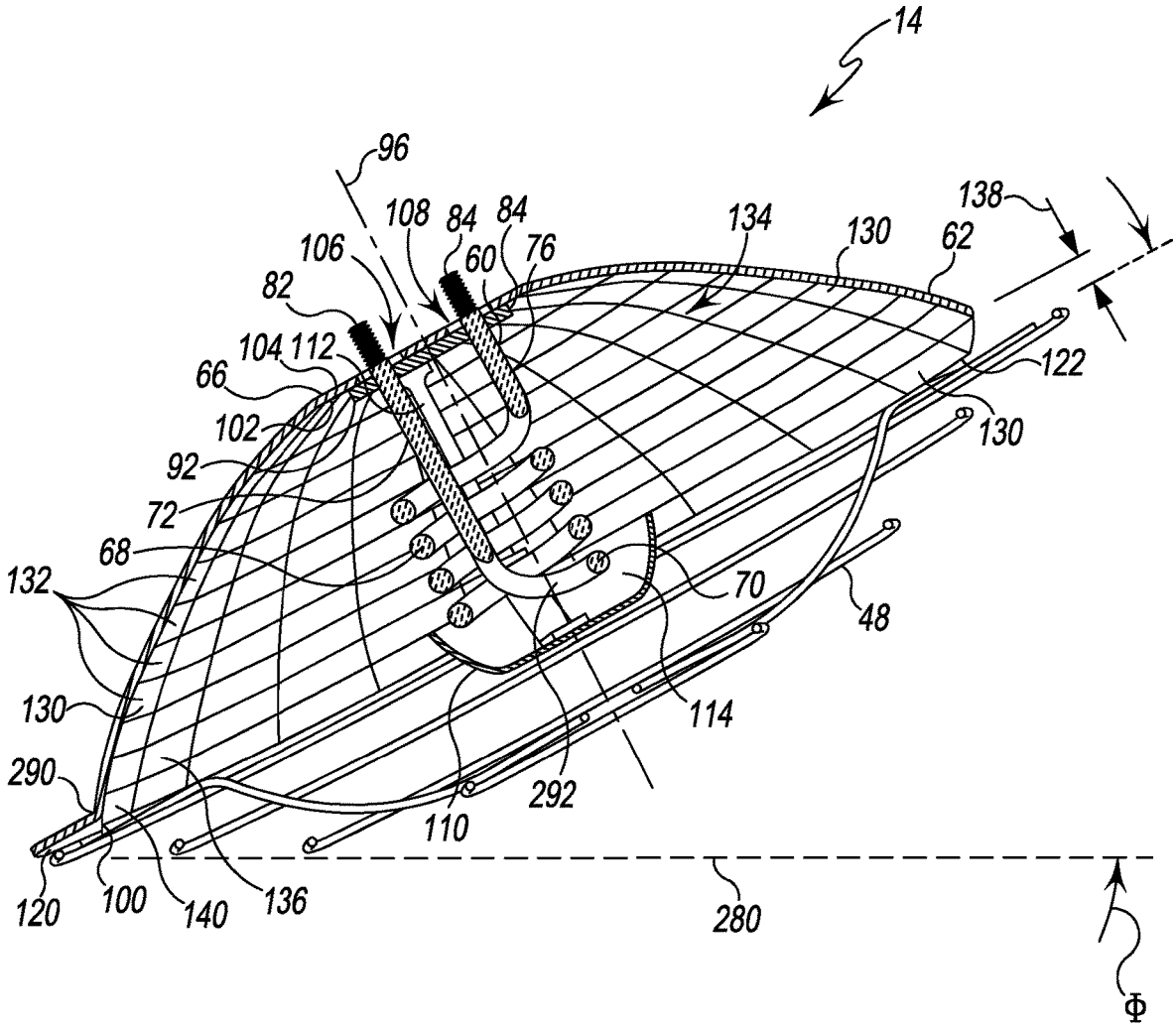
FIG. 4 is a cross-sectional side elevation view illustrating a radiant heater of the infant medical device of FIG. 1.
Figure 5:
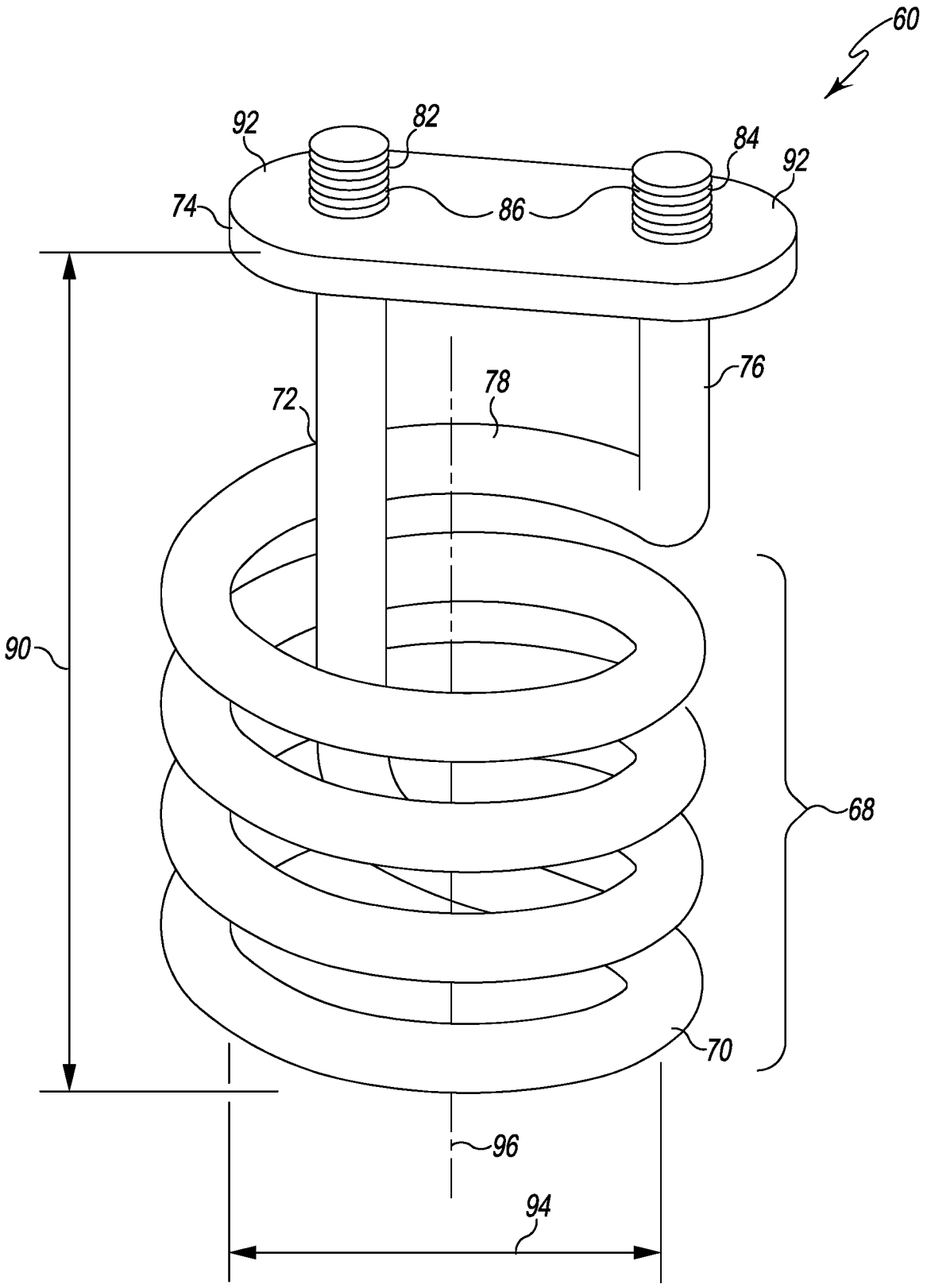
FIG. 5 is a perspective view illustrating the heating element of the radiant heater of FIG. 4.

The heating element 60 is secured to a base 66 of the reflector 62, as shown in FIG. 4. In the illustrative embodiment, the heating element 60 is an infrared heating element including nichrome wire, a super alloy, and insulation material. The super alloy may be Inconel 600. It should be appreciated that in other embodiments other materials may be used in the heating element. The heating element 60 is spiraled and includes a plurality of coils 68. As shown in FIG. 5, the lowermost coil 70 extends inwardly, and the heating element 60 has a shaft 72 that extends upwardly from the coil 70 through the other coils 68. A plate 74 is formed at the upper end of the shaft 72. The heating element 60 has another shaft 76 that extends upwardly from the uppermost coil 78 parallel to the shaft 72. A pair of prongs 82, 84 extend from the plate 74, respectively. Each of the prongs 82, 84 has a threaded lower section 86 configured to receive a nut or other fastener to secure the heating element 60 to the base 66 of the reflector 62. Each of the prongs 82, 84 also includes a contact plate (not shown) configured to engage an electrical connector of the warmer 10 to connect the heating element 60 to the electrical circuitry 34 and hence the power supply.

The heating element 60 has a height 90 defined between the upper surface 92 of the plate 74 and the bottom of the lowermost coil 70. In the illustrative embodiment, the height 90 is selected so that the lowermost coil 70 does not extend beyond the lower edge 100 (see FIG. 4) of the reflector 62. In other embodiments, the lowermost coil 70 may extend outwardly from the reflector 62. As shown in FIG. 5, each coil 68 has a diameter 94, and, in the illustrative embodiment, the diameters 94 are equal. The heating element 60 further has a central axis 96 extending through the center of each of the diameters 94.

Returning to FIG. 4, the base 66 of the reflector 62 has an inner surface 102 and an outer surface 104 positioned opposite the inner surface. A pair of mounting holes 106, 108 extend through the surfaces 102, 104 and are sized to receive the prongs 82, 84, respectively, of the heating element 60. The inner surface 102 of the base 66 is a substantially planar surface, and the plate 74 of the heating element 60 are positioned flush on the inner surface 102 when the heating element 60 is properly secured to the reflector 62, as shown in FIG. 4. In the illustrative embodiment, the inner surface 102 has a surface finish of 8 μ-inches or less.

The radiant heater 14 also includes a deflector dish 110 that is positioned over the lowermost coil 70 of the heating element 60. The dish 110 is connected to the reflector 62 via a bracket 112 secured to the reflector base 66. The dish 110 has a reflective inner surface 114 to direct radiant energy emitted by the heating element 60 away from the patient support. The inner surface 114 is devoid of any openings that would permit radiant energy to pass downward through the dish 110 to the patient support 12. In other embodiments, the dish 110 may include one or more such openings. Further, it should be appreciated that in still other embodiments the deflector dish 110 may be omitted or extend upward above the lowermost coil 70. As shown in FIG. 4, the deflector dish 110 extends outwardly from the reflector 62.

In the illustrative embodiment, the reflector 62 is formed from polished aluminum 3003-O by stamping, machining, hydroforming, or other techniques. It should be appreciated that in other embodiments other metallic materials such as, for example, polished aluminum 1100-O and other manufacturing techniques may be used to make the reflector 62. In other embodiments, the reflector 62 may be formed from multiple pieces that are assembled to form the reflector 62.

The reflector 62 includes an outer rim 120 that is spaced apart from the base 66 and includes the reflector's lower edge 100. The outer rim 120 defines a lower-facing opening 122 of the reflector 62 through which radiant energy exits the reflector 62. The reflector 62 also has an outlet 124 that connects to the lower-facing opening 122 (see FIG. 6). As described above, the reflector 62 includes a plurality of customized facets 130, which are sized and positioned to direct radiant energy emitted by the heating element 60 outwardly through the opening 122 toward the patient support 12. In the illustrative embodiment, the facets 130 are arranged in a number of annular layers 132 around the heating element 60. The layers 132 connect the base 66 to the rim 120 of the reflector 62. The base 66, layers 132, and rim 120 cooperate to define the reflector's inner cavity 134, which partially surrounds the heating element 60. In the illustrative embodiment, the heating element 60 is not entirely enclosed such that the element may be exposed to cooling by convection currents, thereby lowering the surface temperature of the element during operation. Each facet 130 includes a substantially planar reflective surface 136 facing the cavity 134. In the illustrative embodiment, each inner surface 136 has a surface finish of 8 μ-inches or less.

The outlet 124 of the reflector 62 extends through the outer rim 120 and lowermost layers 132 of the reflector 62. In the illustrative embodiment, the outlet 124 is sized to permit excess heat to exit the reflector 62, thereby assisting in preventing the reflector 62 and the heating element 60 from overheating. The outlet illustratively provides a path of least resistance for natural convection currents to leave the reflector area in a controlled manner such that uncontrolled hot air does damage the device or increase the temperature of the reflector area to an undesirable degree. It should be appreciated that the outlet may be positioned elsewhere in the reflector 62 or omitted, depending on the temperature requirements of the medical device.

Referring now to FIGS. 6-25, each layer 132 of facets 130 will be described in greater detail. As described above, each layer 132 has been customized so that each layer 132 (and hence each facet 130) has a unique shape, size, and position. However, in the illustrative embodiment, each layer 132 has the same height 138 (see FIG. 4) and contains the same number of facets 130 (24). It should be appreciated that in other embodiments the number, shape, size, and position of the facets 130 and layers 132 may change depending on, among other things, the size of heating element, the amount of radiant energy to be directed at the patient support, and the position and orientation of the reflector relative to the patient support.

Figure 6:
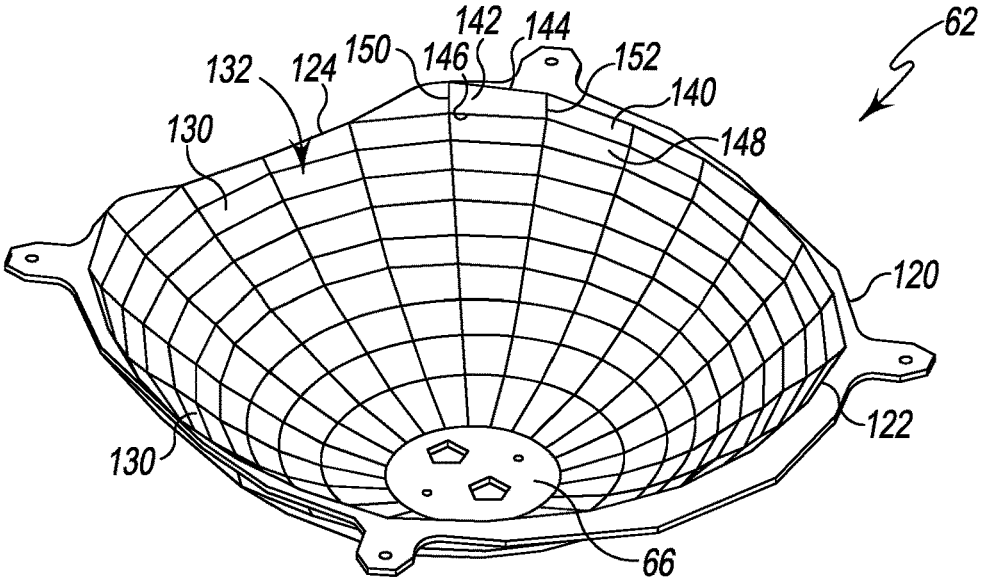
FIG. 6 is a perspective view illustrating the faceted reflector of the radiant heater of FIG. 4.

As shown in FIG. 6, the outer rim 120 of the reflector 62 is connected to a facet layer 140, which is the lowest-most facet layer when the reflector 62 is mounted in the warmer 10. The facet layer 140 is interrupted by the outlet 124, which extends through the layer 140. Except for the facets surrounding the outlet 124, each facet 142 in the layer 140 has a leading edge 144 connected to the rim 120 and a trailing edge 146 connected to the adjacent facet layer 148. Each facet 142 also has a pair of connecting edges 150, 152, which are connected to adjacent facets 142 in the layer 140. The inner reflective surface 136 of each facet 142 is formed by blending the profiles of the edges 144, 146, 150, 152.

The connecting edges 150, 152 of each facet 142 extend along a substantially straight line such that the adjacent facets 142 intersect along the line. In the illustrative embodiment, the leading edge 144 of each facet 142 extends along a substantially straight line, and in that way each facet 142 in the layer 140 intersects the rim 120 along the line. Similarly the trailing edge 146 of each facet 142 intersects a corresponding facet 182 of the adjacent facet layer 148 along a substantially straight line (see FIG. 8). It should be appreciated that, as described above, the facets 142 may take other shapes and sizes in other embodiments. For example, one or more of the facets may be triangular in shape such that the edges of the facet extend at angles to one another.

In some embodiments, the facets may be arranged in sections rather than one or more layers. In such embodiments, the trailing and/or leading edge of each facet may be offset from the trailing and/or leading edge of an adjacent facet.

Figure 7:
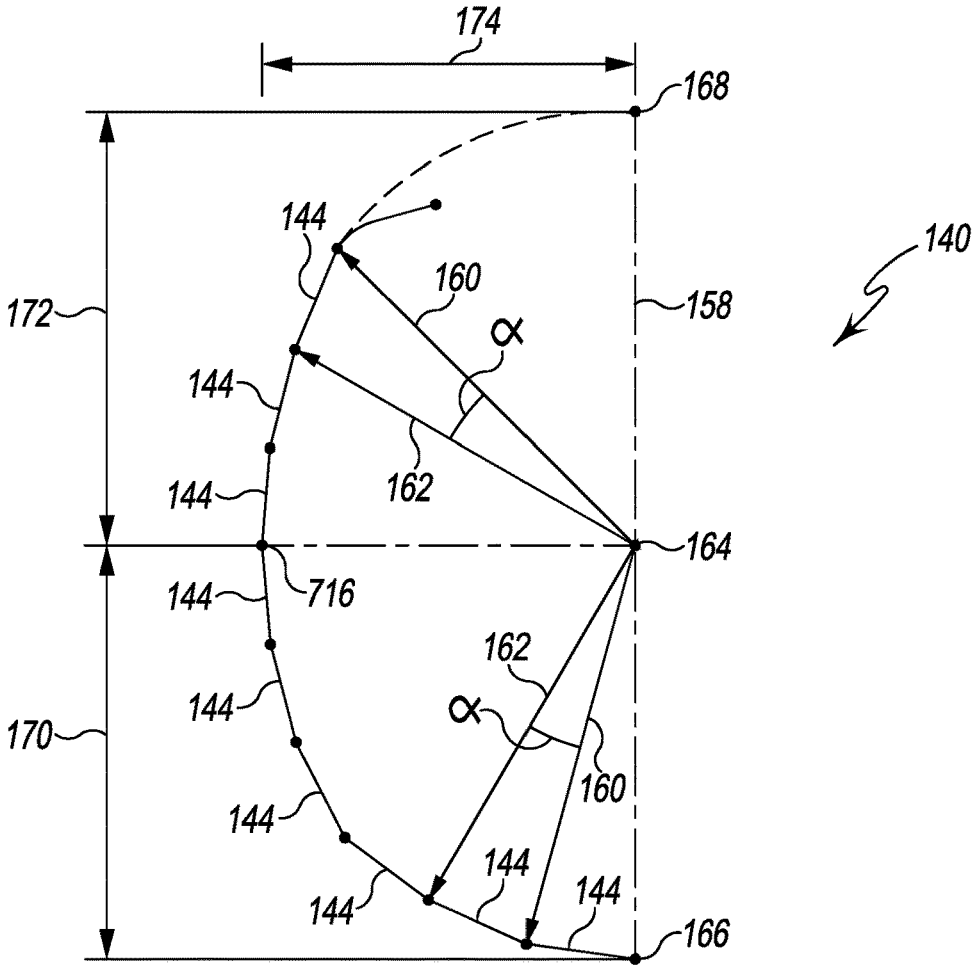
FIG. 7 is a diagrammatic view of an edge that connects the highlighted facet layer of FIG. 6 with the rim of the reflector.

In the illustrative embodiment, the configuration of the facet layer 140 is symmetrical along its front-rear center line 158, which is shown in FIG. 7. The center line 158 divides the facet layer 140 into two halves. Because the halves are mirror images of each other, only one half of the facet layer 140 will be described in detail below. As shown in FIG. 7, a pair of lines 160, 162 extend outwardly from a reference point 164 to the ends of each facet leading edge 144 (and hence to the ends of the straight line along which the facets intersect). The reference point 164 lies on the front-rear center line 158 and, in the illustrative embodiment, on the central axis 96 of the heating element 60 when the heating element 60 is properly secured to the reflector 62. An angle $\alpha$ is defined between each pair of lines 160, 162. In the illustrative embodiment, the angle $\alpha$ is equal to about 15 degrees.

The front-rear center line 158 has a pair of end points 166, 168 that define the front and rear ends of the facet layer 140. A distance 170 is defined between the end point 166 and the reference point 164, and another distance 172 is defined between the end point 168 and the reference point 164. In the illustrative embodiment, the distance 170 is equal to about 4.9 inches, and the distance 172 is equal to about 5.1 inches; in other words, the distance 170 is less than the distance 172. The layer 140 also has a maximum width that is less than the sum of distances 170, 172. In the illustrative embodiment, the maximum width of the layer 140 is defined as twice the distance 174 shown in FIG. 7, which is defined between an endpoint 176 and the front-rear center line 158.

Figure 8:
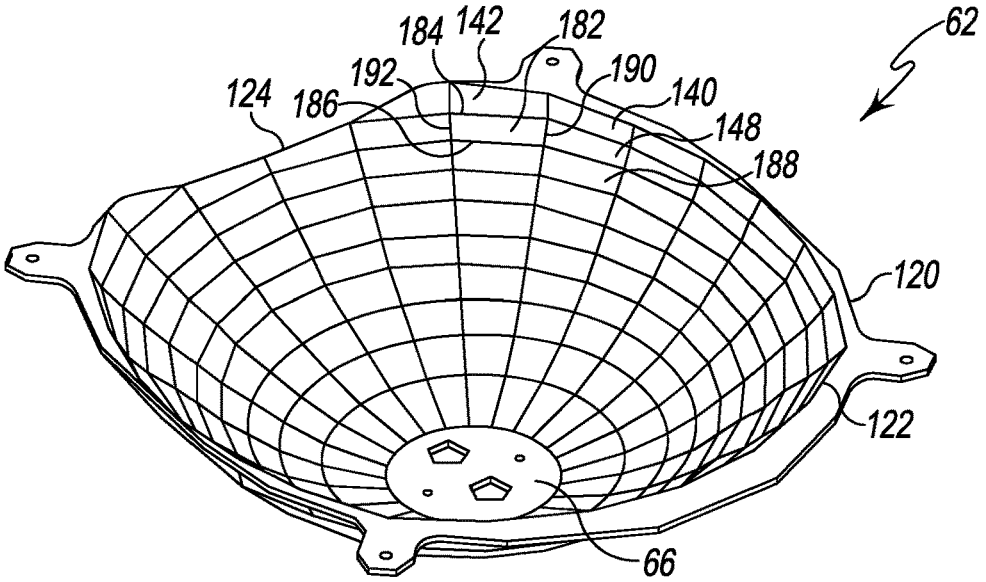
FIG. 8 is a view similar to FIG. 6 in which another facet layer of the reflector is highlighted.
Figure 9:
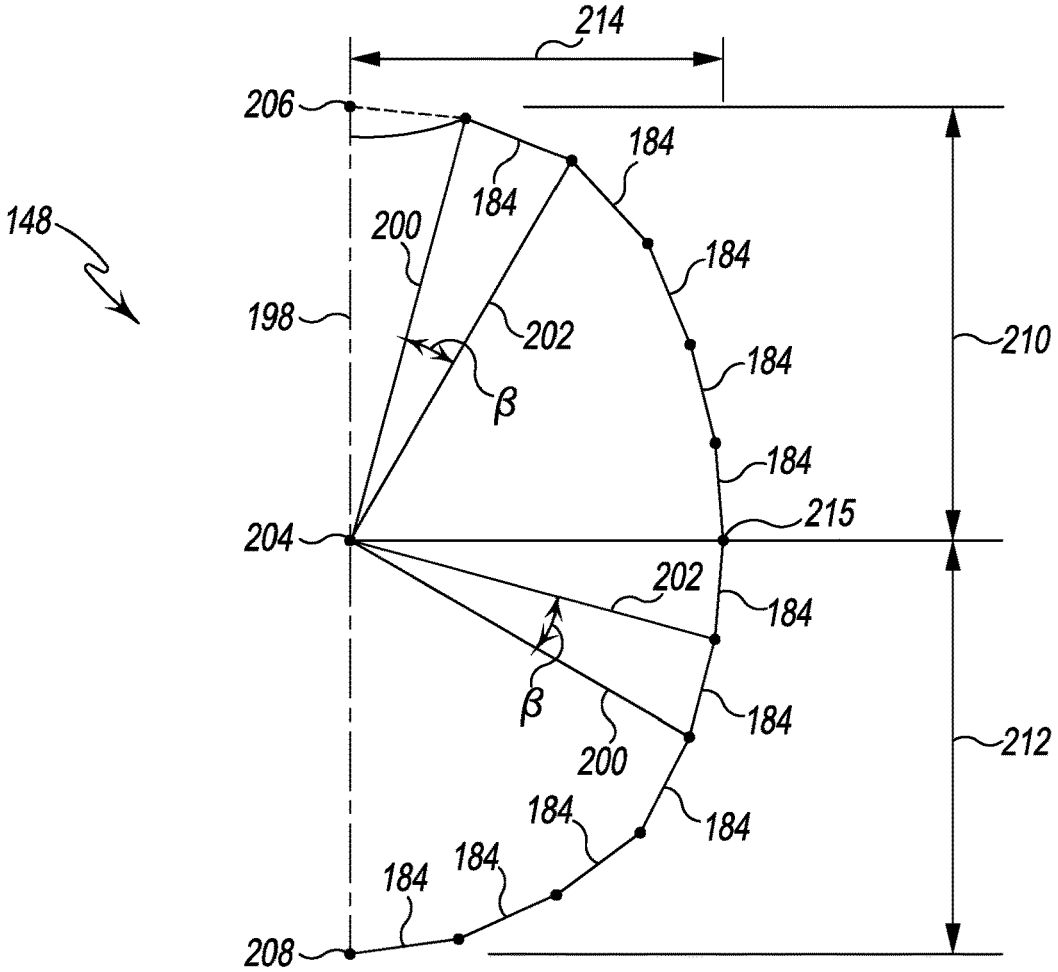
FIG. 9 is a diagrammatic view of an edge that connects the highlighted facet layer of FIG. 8 with the facet layer highlighted in FIG. 6.

Referring now to FIGS. 8-9, the facet layer 140 is connected to an adjacent facet layer 148. The facet layer 148, like the facet layer 140, is interrupted by the outlet 124, which extends through the layer 140. Except for the facets 142 surrounding the outlet 124, each facet 182 of the layer 148 has a leading edge 184 connected to the facet layer 140 and a trailing edge 186 connected to the adjacent facet layer 188. Each facet 182 also has a pair of connecting edges 190, 192 that are connected to adjacent facets 182 in the layer 148. The inner reflective surface 136 of each facet 182 is formed by blending the profiles of the edges 184, 186, 190, 192. In the illustrative embodiment, all of the edges 184, 186, 190, 192 extend along substantially straight lines such that each facet 182 intersects the facets surrounding it along substantially straight lines. It should be appreciated that, as described above, the facets 182 may take other shapes and sizes in other embodiments. For example, one or more of the facets may be triangular in shape such that the edges of the facet extend at angles to one another. In some embodiments, the facets may be arranged in sections rather than one or more layers. In such embodiments, the trailing and/or leading edge of each facet may be offset from the trailing and/or leading edge of an adjacent facet.

In the illustrative embodiment, the configuration of the facet layer 148, like the configuration of the facet layer 140, is symmetrical along a front-rear center line 198 that is shown in FIG. 9. The front-rear center line 198 lies in a vertically-extending plane with the front-rear center line 158 of the layer 140 and, like the center line 158, divides the facet layer 148 into two halves, one of which is described in greater detail below. As shown in FIG. 9, a pair of lines 200, 202 extend outwardly from a reference point 204 to the ends of each facet leading edge 184 (and hence to the ends of the straight line along which the facets intersect). The reference point 204 lies on the front-rear center line 198 and, in the illustrative embodiment, on the central axis 96 of the heating element 60 when the heating element 60 is properly secured to the reflector 62. An angle $\beta$ is defined between each pair of lines 200, 202. The value of the angle $\beta$ for layer 148 is included in the table 216 shown in FIG. 27.

The front-rear center line 198 has a pair of endpoints 206, 208 that define the front and rear ends of the facet layer 148. A distance 210 is defined between the endpoint 206 and the reference point 204, and another distance 212 is defined between the endpoint 208 and the reference point 204. In the illustrative embodiment, the distance 210 is less than the distance 212. The layer 140 also has a maximum width that is less than the sum of distances 210, 212. In the illustrative embodiment, the maximum width of the layer 148 is defined as twice the distance 214 shown in FIG. 9, which is defined between an endpoint 215 and the front-rear center line 198. The values of the distances 210, 212, 214 for the layer 148 are included in the table 216 shown in FIG. 27.

Referring now to FIGS. 10-25, the configurations of facet layers 148, 188, 218, 220, 222, 224, 226, 228, 230, 232 are shown in greater detail. In the illustrative embodiment, the general configuration of each of those facet layers is substantially similar to the configuration of the facet layer 140. Accordingly, the same reference numbers are used in reference to similar features. For example, as described above, the facet layer 148 is connected to an adjacent facet layer 188. Each facet 182 of the layer 188 has a leading edge 184 connected to the previous facet layer (i.e., layer 148) and a trailing edge 186 connected to the next adjacent facet layer (i.e., layer 218). Each facet 182 also has a pair of connecting edges 190, 192 that are connected to adjacent facets 182 in the layer 188. The inner reflective surface 136 of each facet 182 is formed by blending the profiles of the edges 184, 186, 190, 192. In the illustrative embodiment, all of the edges 184, 186, 190, 192 extend along substantially straight lines such that each facet 182 intersects the facets surrounding it along substantially straight lines. It should be appreciated that, as described above, the facets 182 may take other shapes and sizes in other embodiments. For example, one or more of the facets may be triangular in shape such that the edges of the facet extend at angles to one another. In some embodiments, the facets may be arranged in sections rather than one or more layers. In such embodiments, the trailing and/or leading edge of each facet may be offset from the trailing and/or leading edge of an adjacent facet.

Figure 10:
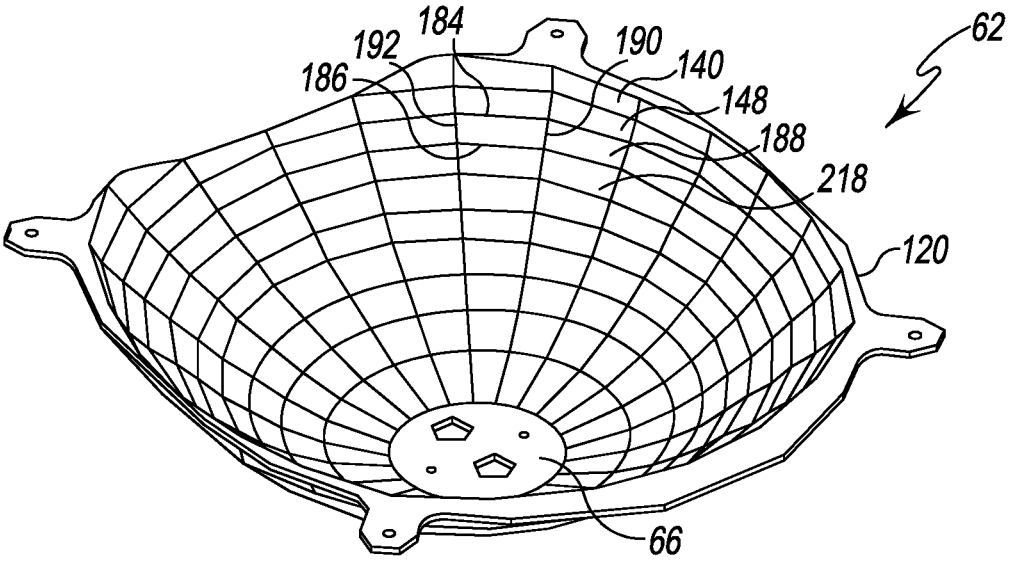
FIG. 10 is a view similar to FIGS. 6 and 8 in which another facet layer of the reflector is highlighted.
Figure 11:
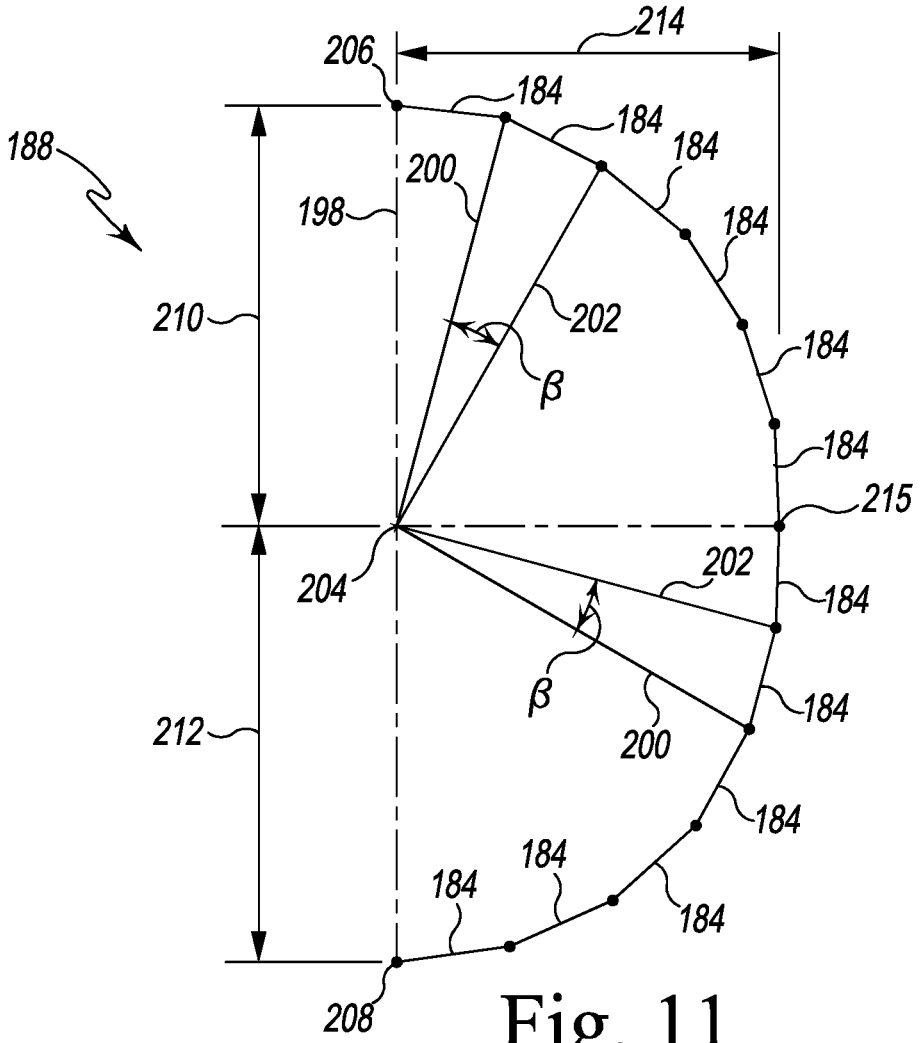
FIG. 11 is a diagrammatic view of an edge that connects the highlighted facet layer of FIG. 11 with the facet layer highlighted in FIG. 8.
Figure 12:
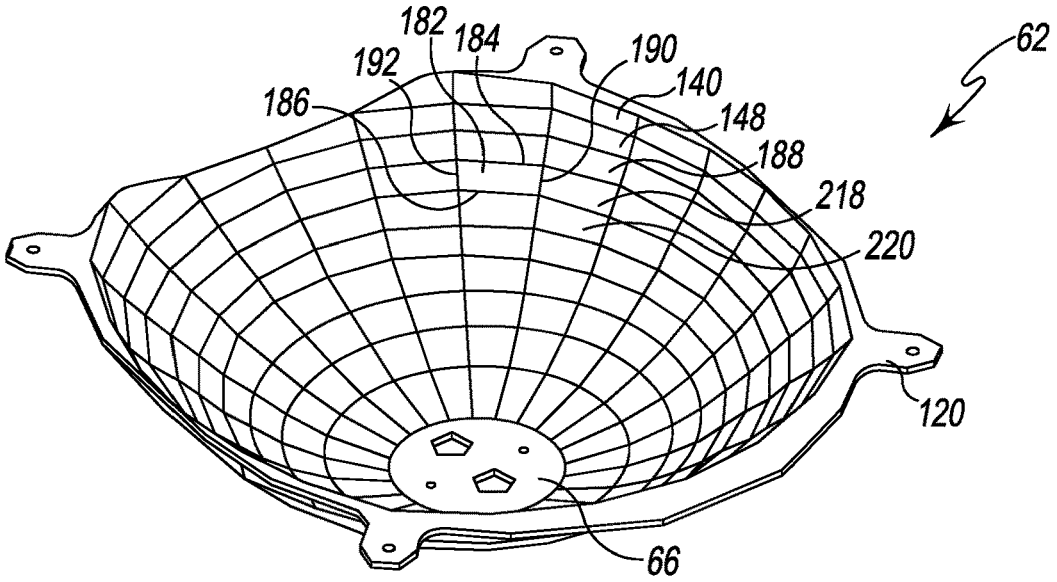
FIG. 12 is a view similar to FIGS. 6, 8, and 10 in which another facet layer of the reflector is highlighted.
Figure 13:
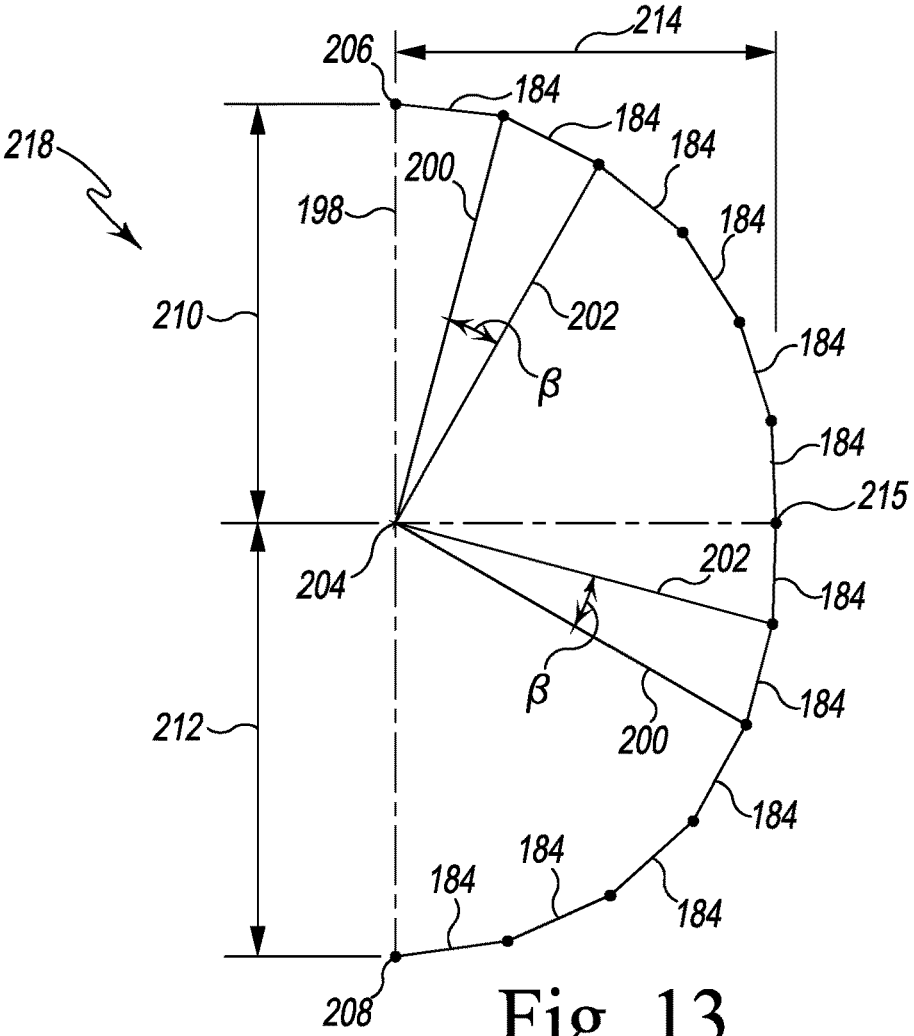
FIG. 13 is a diagrammatic view of an edge that connects the highlighted facet layer of FIG. 12 with the facet layer highlighted in FIG. 10.
Figure 14:
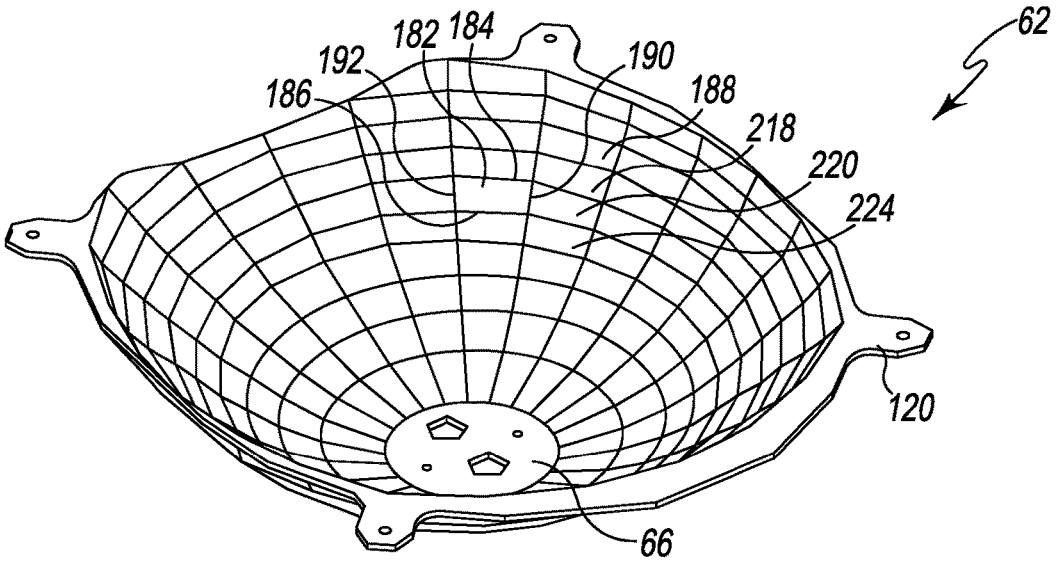
FIG. 14 is a view similar to FIGS. 6, 8, 10, and 12 in which another facet layer of the reflector is highlighted.
Figure 15:
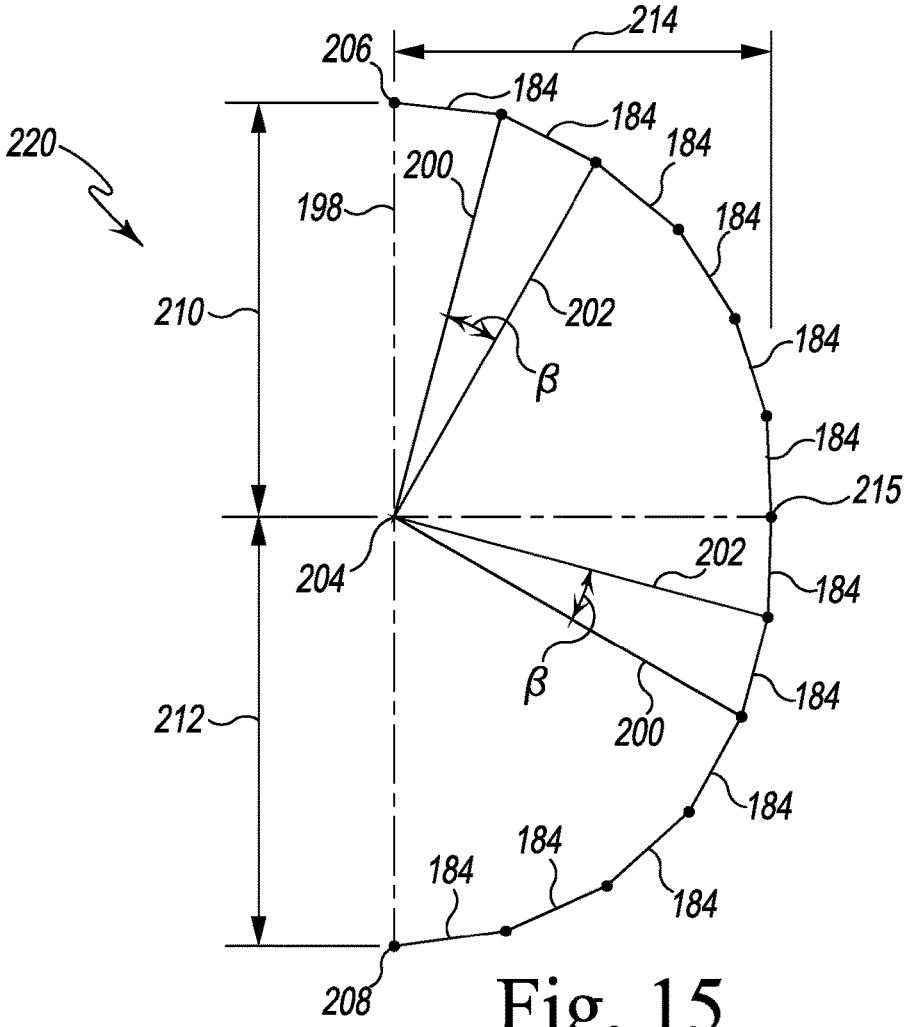
FIG. 15 is a diagrammatic view of an edge that connects the highlighted facet layer of FIG. 14 with the facet layer highlighted in FIG. 12.
Figure 16:
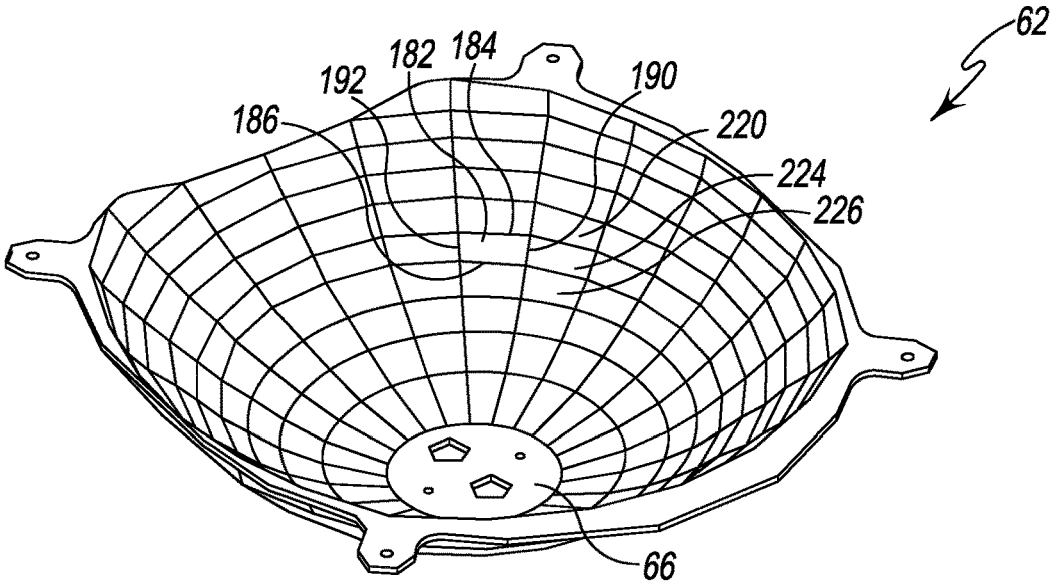
FIG. 16 is a view similar to FIGS. 6, 8, 10, 12, and 14 in which another facet layer of the reflector is highlighted.
Figure 17:
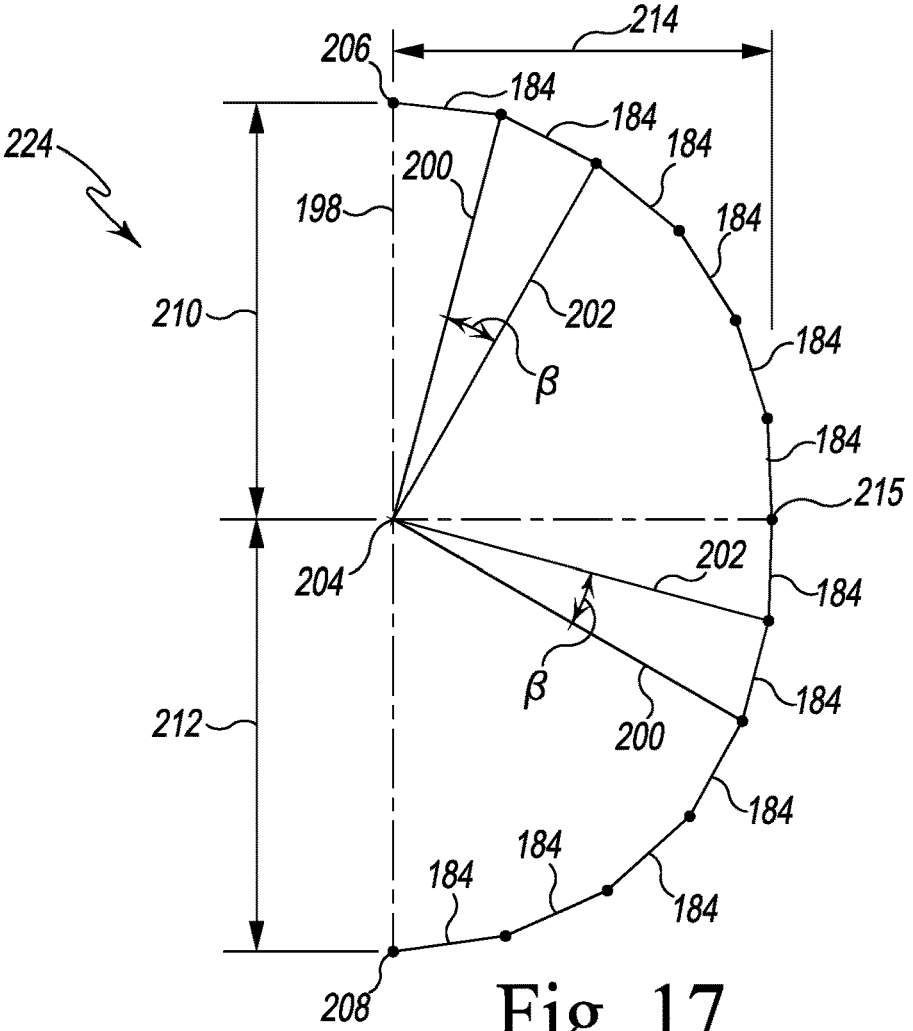
FIG. 17 is a diagrammatic view of an edge that connects the highlighted facet layer of FIG. 16 with the facet layer highlighted in FIG. 14.
Figure 18:
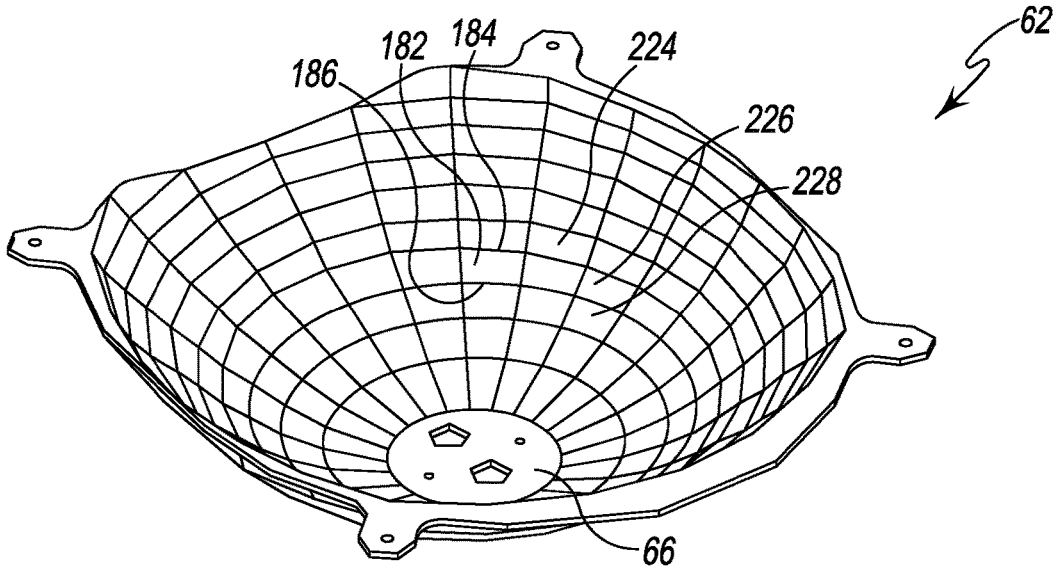
FIG. 18 is a view similar to FIGS. 6, 8, 10, 12, 14, and 16 in which another facet layer of the reflector is highlighted.
Figure 19:
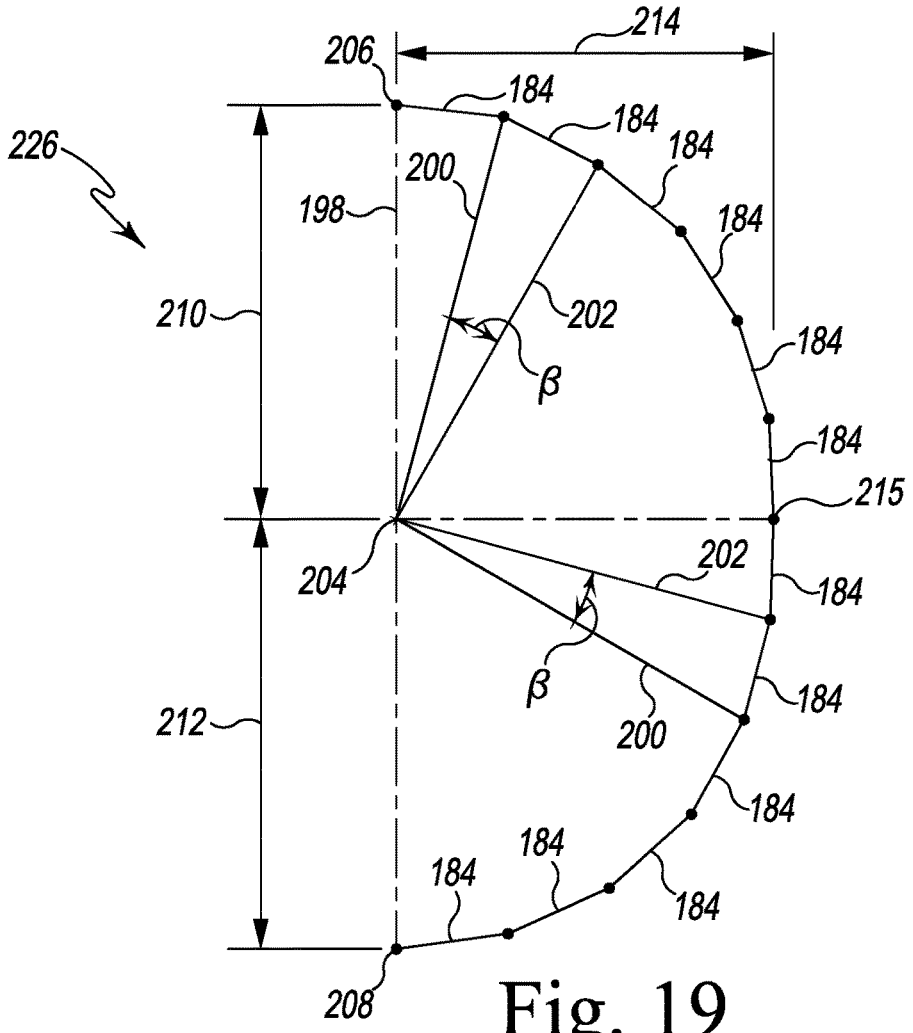
FIG. 19 is a diagrammatic view of an edge that connects the highlighted facet layer of FIG. 18 with the facet layer highlighted in FIG. 16.
Figure 20:
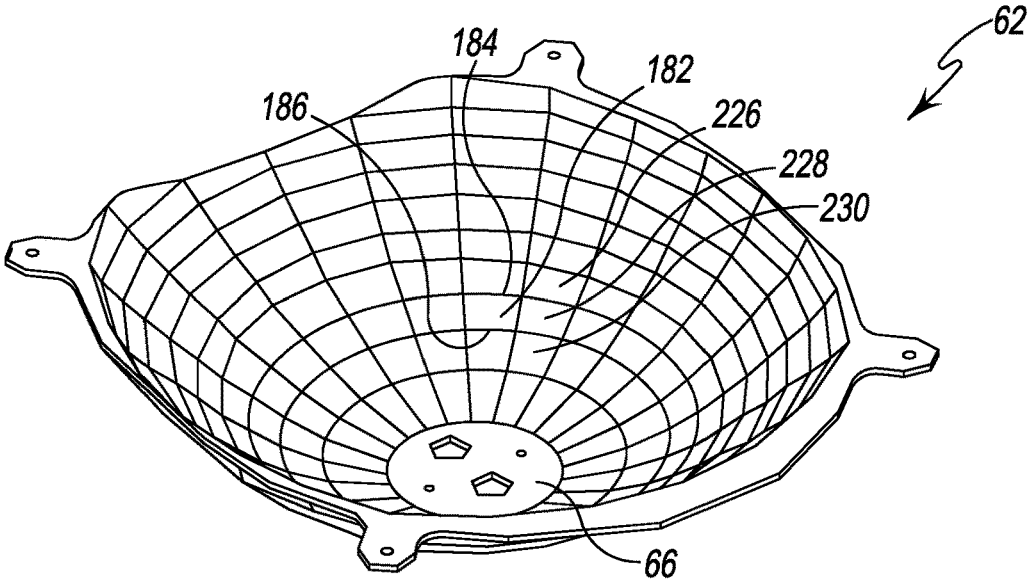
FIG. 20 is a view similar to FIGS. 6, 8, 10, 12, 14, 16, and 18 in which another facet layer of the reflector is highlighted.
Figure 21:
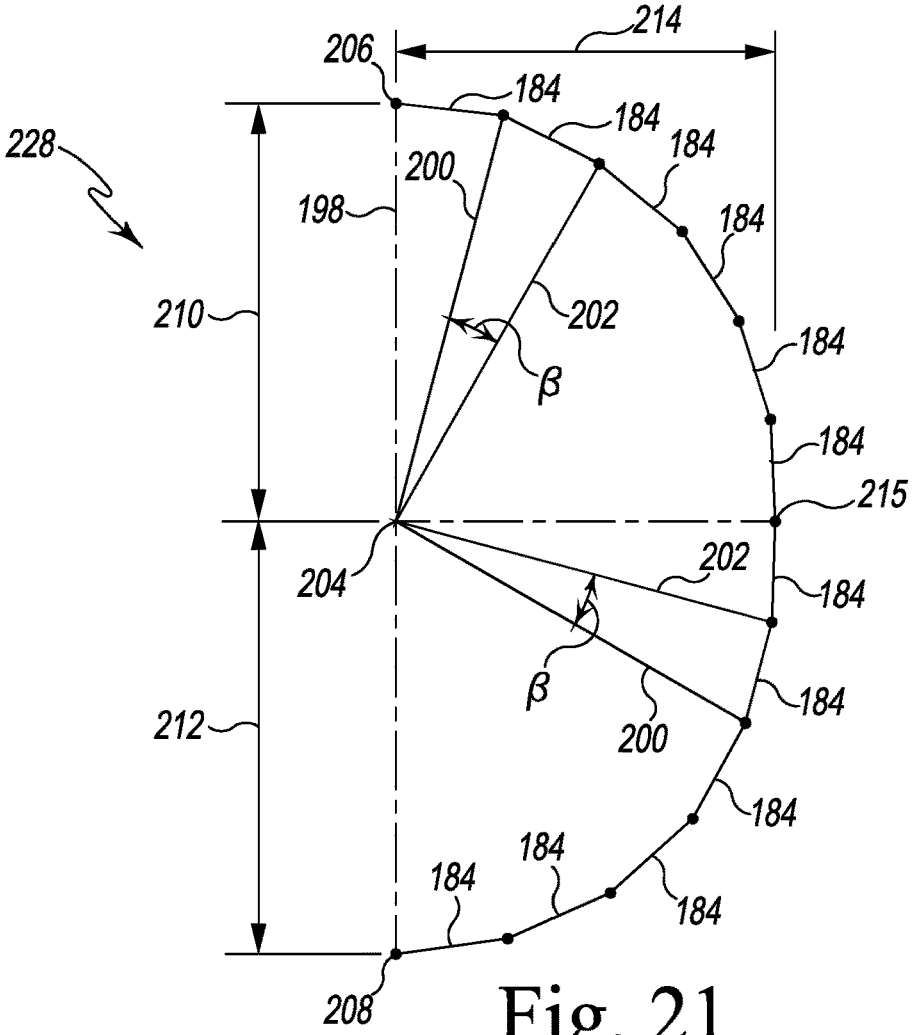
FIG. 21 is a diagrammatic view of an edge that connects the highlighted facet layer of FIG. 20 with the facet layer highlighted in FIG. 18.
Figure 22:
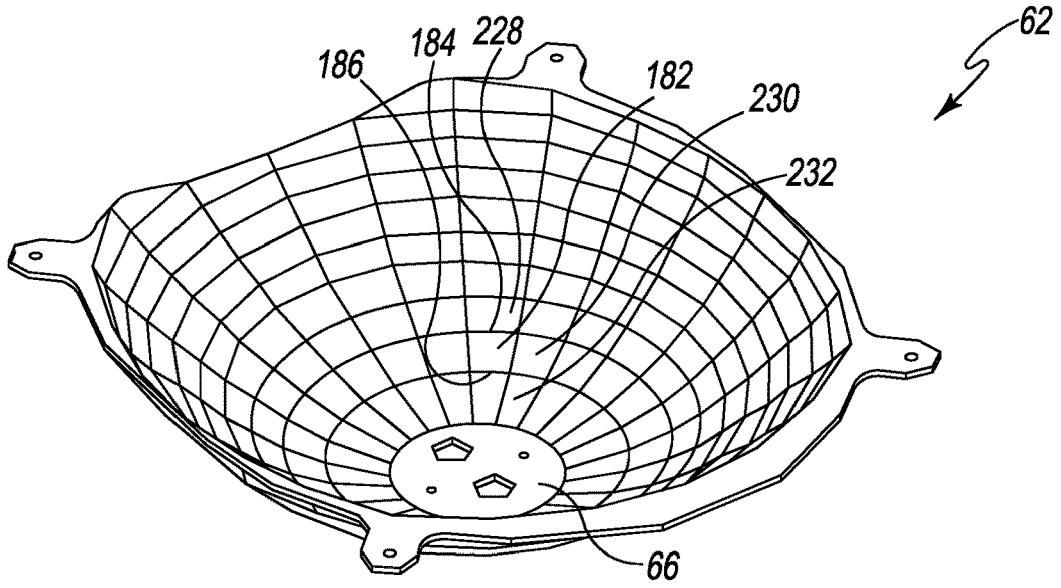
FIG. 22 is a view similar to FIGS. 6, 8, 10, 12, 14, 16, 18, and 20 in which another facet layer of the reflector is highlighted.
Figure 23:
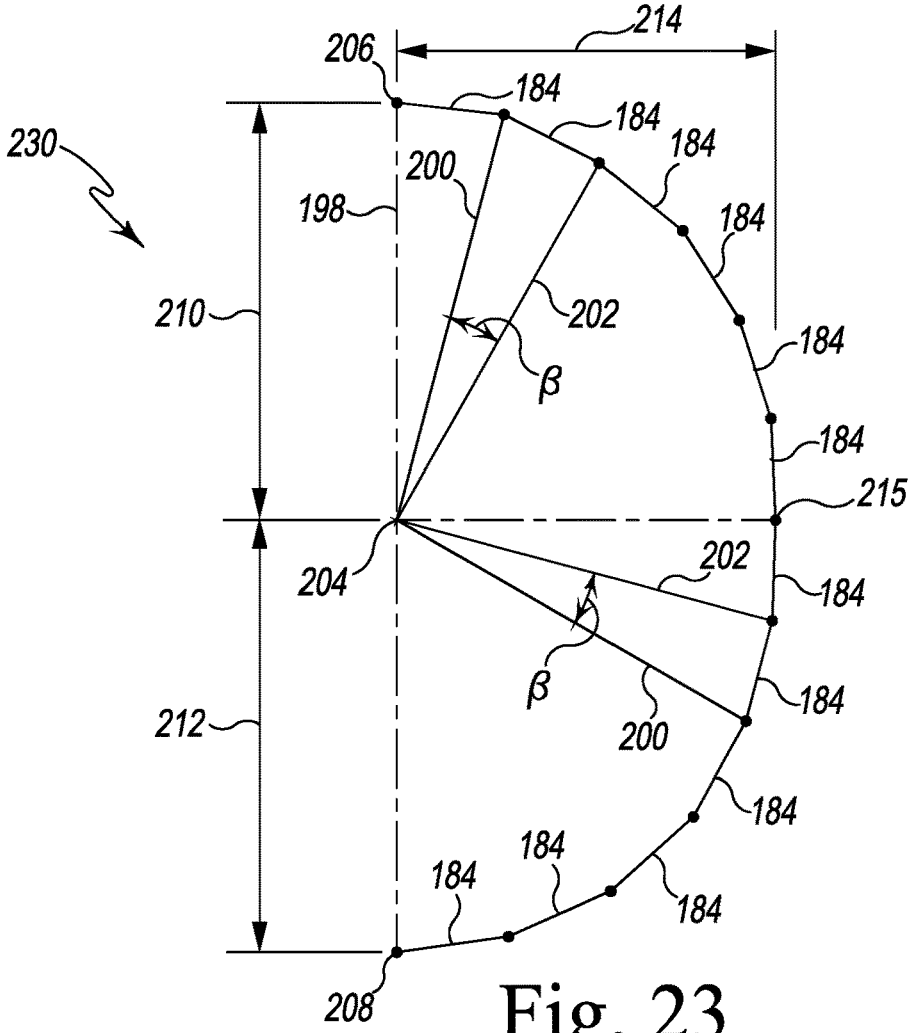
FIG. 23 is a diagrammatic view of an edge that connects the highlighted facet layer of FIG. 22 with the facet layer highlighted in FIG. 20.

The configuration of the facet layer 188, like the configuration of the facet layer 148, is symmetrical along a front-rear center line 198 that is shown in FIG. 10. The front-rear center line 198 lies in a vertically-extending plane with the front-rear center line 158 of the layer 140 and, like the center line 158, divides the facet layer 188 into two halves, one of which is described in greater detail below. As shown in FIG. 11, a pair of lines 200, 202 extend outwardly from a reference point 204 to the ends of each facet leading edge 184 (and hence to the ends of the straight line along which the facets intersect). The reference point 204 lies on the front-rear center line 198 and, in the illustrative embodiment, on the central axis 96 of the heating element 60 when the heating element 60 is properly secured to the reflector 62. An angle $\beta$ is defined between each pair of lines 200, 202. The value of the angle $\beta$ for the facet layer 188 is included in the table 216 shown in FIG. 27.

The front-rear center line 198 has a pair of endpoints 206, 208 that define the front and rear ends of the facet layer 188. A distance 210 is defined between the endpoint 206 and the reference point 204, and another distance 212 is defined between the endpoint 208 and the reference point 204. In the illustrative embodiment, the distance 210 is less than the distance 212. The values of the distances 210, 212, 214 for the layer 188 are included in the table 216 shown in FIG. 27.

Figure 27:
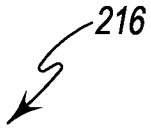
FIG. 27 includes a table of values for various elements of the facet layers of FIGS. 22-26.
Figure 28:
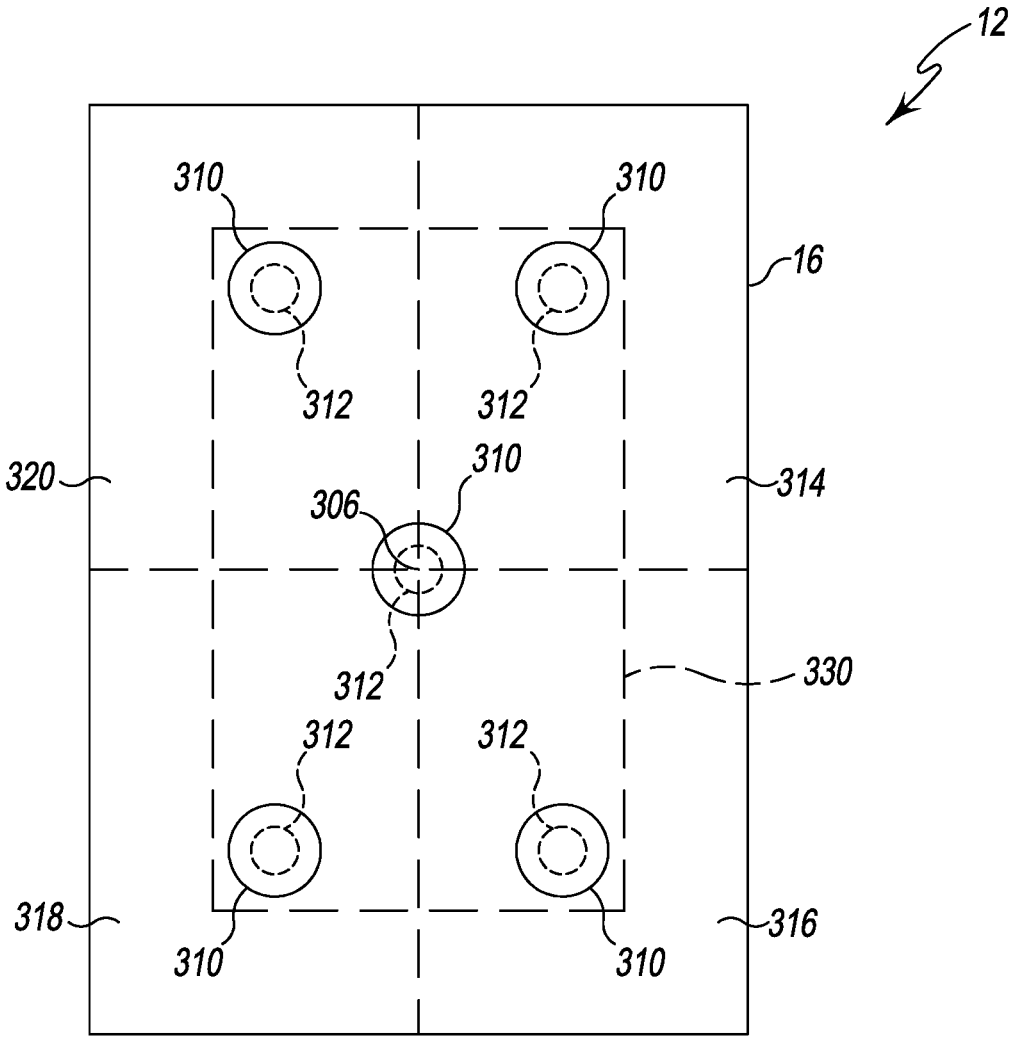
FIG. 28 is a plan view of the patient support of the infant medical device of FIG. 1.

The table 216 of FIG. 27 includes values for angle β and the distances 210, 212, 214 for each of the layers 188, 218, 220, 224, 226, 228, 230, 232 of FIGS. 10-25. It should be noted that, in contrast to the other layers 188, 218, 220, 224, 226, 228, the distance 210 is equal to the distance 212 in the layers 230, 232, which are shown in FIGS. 22-25. Additionally, it should be appreciated that the distance 214 is equal to the distance 210 and the distance 212 in the layers 230, 232. As described above, in other embodiments the values for angle β and the distances 210, 212 may be different depending on, among other things, the size of heating element, the amount of radiant energy to be directed at the patient support, and the position and orientation of the reflector relative to the patient support.

Figure 24:
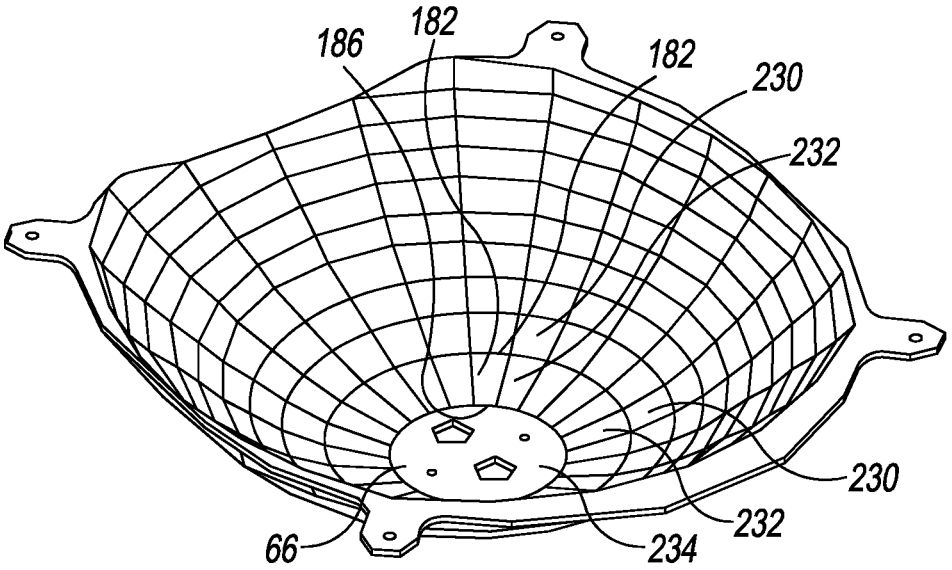
FIG. 24 is a view similar to FIGS. 6, 8, 10, 12, 14, 16, 18, 20 and 22 in which another facet layer of the reflector is highlighted.
Figure 25:
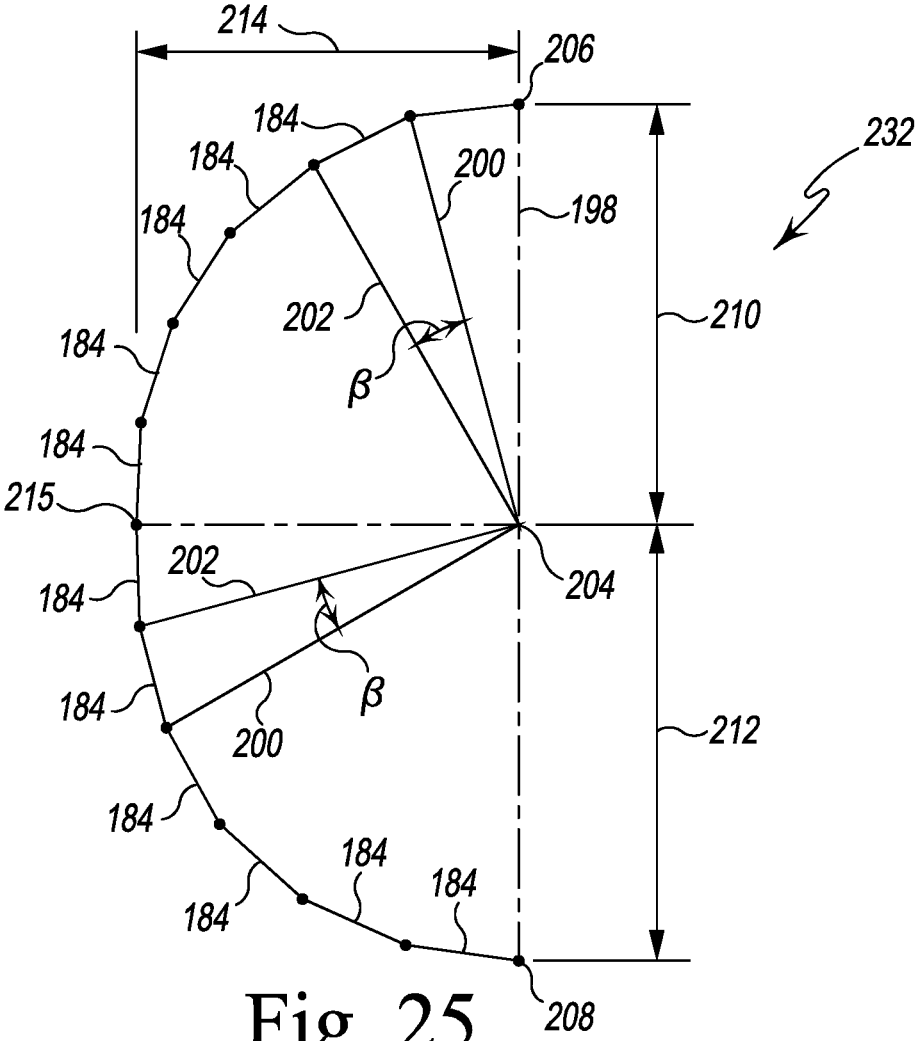
FIG. 25 is a diagrammatic view of an edge that connects the highlighted facet layer of FIG. 24 with the highlighted faceted layer of FIG. 22.
Figure 26:
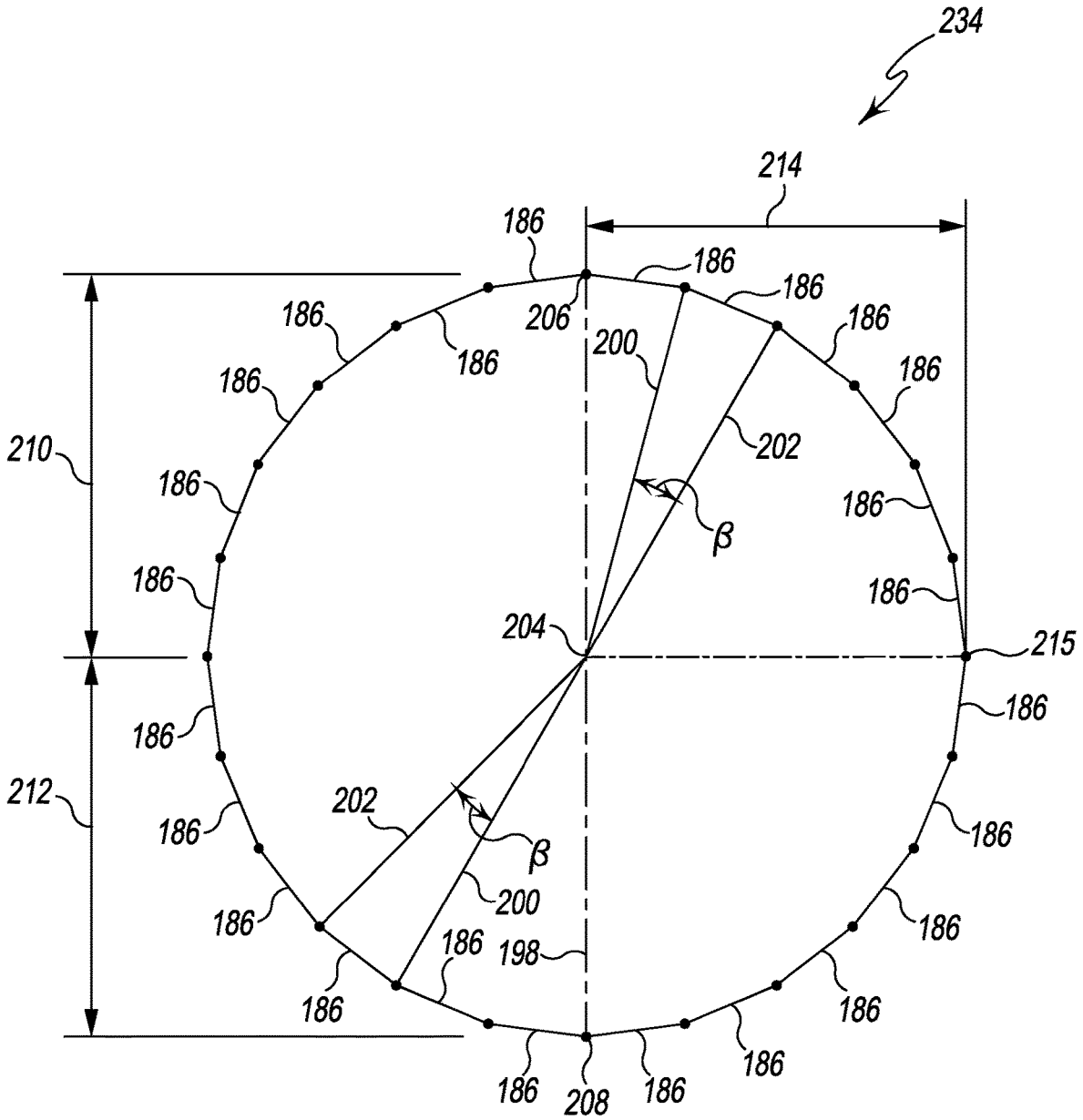
FIG. 26 is a diagrammatic view of an edge that connects the highlighted facet layer of FIG. 24 with the base facet of the reflector.

Referring now to FIGS. 24-26, the base 66 of the reflector 62 is connected to a facet layer 232, which is the upper-most facet layer when the reflector 62 is mounted in the warmer 10. It should also be noted that, in the illustrative embodiment, the inner surface 102 of the base 66 is also a reflective surface and hence is another facet 234 of the reflector 62. As shown in FIG. 24, the base 66 intersects the facet layer 232 along the edges 186 of the facets 182 of the layer 232. As shown in FIG. 26, a pair of lines 200, 202 extend outwardly from a reference point 204 to the ends of each facet trailing edge 184 (and hence to the ends of the straight line along which the facets intersect). The reference point 204 lies on the front-rear center line 198 of the facet 234 and, in the illustrative embodiment, on the central axis 96 of the heating element 60 when the heating element 60 is properly secured to the reflector 62. An angle β is defined between each pair of lines 200, 202. The value of the angle β for the facet 234 is included in the table 216 shown in FIG. 27.

As shown in FIG. 26, the front-rear center line 198 has a pair of endpoints 206, 208 that define the front and rear ends of the facet 234. A distance 210 is defined between the endpoint 206 and the reference point 204, and another distance 212 is defined between the endpoint 208 and the reference point 204. In the illustrative embodiment, the distance 210 is equal to the distance 212. The values of the distances 210, 212, 214 for the facet 234 are included in the table 216 shown in FIG. 27.

It should be appreciated that in some embodiments the outer edge of the facet 234 may define a circle. In other embodiments, the edge may define other geometric shapes, including an oval, oblong, or polygonal shapes. As described above, the size of the facet 234 may vary in other embodiments depending on the size of heating element, the amount of radiant energy to be directed at the patient support, and the position and orientation of the reflector relative to the patient support.

In the illustrative embodiment, the center lines of the facet layers 132 lie in a common, vertically-extending plane with the front-rear center line 274 (see FIG. 1) of the patient support 12 such that the reflector 62 is symmetrical about the patient support center line 274. In other embodiments, the reflector 62 may be offset from the center line 274 to the left or right by an amount in a range of less than or equal to 1 inch.

Returning to FIG. 4, the reflector 62 is angled relative to the patient support 12. In the illustrative embodiment, the patient support 12 extends generally parallel to a horizontal plane 280 shown in FIG. 4. The lower edge 100 of the outer rim 120 of the reflector 62 defines a plane 282, and an angle φ is defined between the planes 280, 282. The magnitude of the angle φ corresponds to the amount the reflector 62 is angled relative to the patient support 12. In the illustrative embodiment, the angle φ is equal to about 22.5 degrees. In other embodiments, the angle φ may be in a range of 19.5 and 24 degrees.

As shown in FIG. 4, the lower-most facet layer 140 includes the lowest-most point 290 of the reflective portion of the reflector 62. Returning to FIG. 2, a vertical distance 300 is defined between the lower-most point 290 of the facet layer 140 and the plane 302 of the patient support 12. In the illustrative embodiment, the distance 300 is equal to about 31.977 inches. In other embodiments, the distance 300 may be in a range of 29 and 34 inches.

As shown in FIG. 2, the support column 28 extends along an axis 304. An angle λ is defined between the axis 304 and the plane 302 of the patient support 12. In the illustrative embodiment, the angle λ is equal to about 90 degrees. In other embodiments, the angle λ may be in a range of 89 and 93.5 degrees.

Returning to FIG. 4, the plane 282 defined by the outer rim 120 intersects the central axis 96 of the heating element 60 at a point 292. As shown in FIG. 2, the point 292 (and hence the reflector 62) is offset from the front-rear center point 306 of the patient support 12 by a distance 308. In the illustrative embodiment, the distance 308 is equal to 12.949 inches. The reflector 62 may also be offset in the front-rear direction by an amount in a range of 1 to 2 inches. In the illustrative embodiment, the point 292 is offset vertically from the plane 302 of the patient support 12 by 33.553 inches.

As described above, the warmer 10 is configured such that the reflector 62 directs sufficient radiant energy to the patient support 12 to heat the patient support and maintain at least a portion of the patient support at a predetermined temperature. To do so, a caregiver accesses the user interface 32 to operate the electrical circuitry 34 of the warmer 10. The electrical circuitry 34, which may be connected to a standard wall electrical outlet or other power source, supplies power to the heating element 60 to energize element and cause it to emit radiant energy. Some of the energy emitted by the heating element 60 is received by the deflector dish 110, which redirects the energy away from the patient support. This redirected energy, along with much of the energy emitted by the heating element 60, advances into contact with the facets 130 of the reflector 62. The facets 130, by their position, orientation, shape, and size, are configured to direct the energy toward the patient support 12.

Whether the radiant energy provided to the patient support 12 is sufficient to heat the patient support and maintain at least a portion of the patient support at a predetermined temperature may be determined according the voluntary standard 60601-2-21 for infant radiant warmers, which has been published by the Association for the Advancement of Medical Instrumentation (AAMI) and is incorporated herein by reference. Under that standard, five test devices 310 are placed on the mattress 16 of the patient support 12, as shown in FIG. 27. Each test device 310 is an aluminum disk having a specific size, shape, and mass and coated with an anti-reflective black paint. A temperature sensor 312 is placed in each test device 310.

In a controlled environment, four of the test devices are placed at the centers of each of the four rectangles 314, 316, 318, 320 formed by bisecting the length and width of the mattress 16, as shown in FIG. 27. The fifth device 310 may be placed at the mid-point of the mattress 16 (i.e., center point 306). As shown in FIG. 27, the test devices 310 define a region 330 of the patient support 12 that should be maintained at a substantially consistent predetermined temperature at steady state The user may then use the user interface 32 to energize the heating element 60. When the sensors 312 indicate that the temperature at the patient support 12 reaches a predetermined steady state temperature, the user may take at least 20 readings of each test device at regular intervals over a 60 minute period. In the illustrative embodiment, the predetermined steady state temperature is approximately 36° C. The user may then calculate the average temperature of each test device 310. To do so, the user may sum the individual temperature readings of each device and then divide the sum by the total number of temperature readings. In the illustrative embodiment, the difference between the average temperatures of the test devices 310 should not exceed 0.5° C. Additionally, the difference between the average temperature of each outer test devices and the center test device 310 should not exceed 2.0° C.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A medical device for infant care, the medical device comprising:

a patient support sized to receive a body of an infant, and a radiant heater positioned above the patient support, the radiant heater comprising:

an infrared heating element operable to emit radiant energy, and an asymmetric reflector that partially surrounds the infrared heating element, the asymmetric reflector including a plurality of customized facets to direct radiant energy emitted by the infrared heating element toward a predefined region of the patient support to maintain the predefined region at a predetermined temperature, the asymmetric reflector further including an outer rim, a first customized facet of the plurality of customized facets positioned opposite the outer rim, the first customized facet including a planar inner surface that has a front end and a rear end positioned on a first front-rear center line, and a number of layers of customized facets positioned between the first customized facet and the outer rim, each layer of customized facets having a front end and a rear end, wherein the number of layers of customized facets includes a first layer having a second front-rear center line extending from the front end to the rear end of the first layer, wherein the infrared heating element is coupled to the planar inner surface of the first customized facet, and wherein the infrared heating element has a central axis that extends through a first reference point on the planar inner surface of the first customized facet and through a second reference point on the second front-rear center line of the first layer, and wherein the first reference point is positioned on the first front-rear center line equidistant from the front and rear ends of the first customized facet, and wherein the second reference point is positioned a first distance from the front end of the first layer and a second distance from the rear end that is different from the first distance.

2. The medical device of claim 1, wherein each layer of customized facets has a height, the height of each layer being the same.

3. The medical device of claim 1, wherein the customized facets in each layer are equal in number.

4. The medical device of claim 1, wherein the number of layers of customized facets includes a first layer, and each customized facet of the first layer intersects the first customized facet along a curved line.

5. The medical device of claim 4, wherein each customized facet of the first layer intersects an adjacent customized facet of the first layer along a substantially straight line.

6. The medical device of claim 4, wherein:

the number of layers of customized facets includes a second layer, and the first layer is positioned between the first customized facet and the second layer, and each customized facet of the second layer intersects a customized facet of the first layer along a substantially straight line.

7. The medical device of claim 6, wherein each customized facet of the second layer intersects an adjacent customized facet of the first layer along a substantially straight line.

8. The medical device of claim 1, wherein each customized facet of each layer of customized facets intersects an adjacent customized facet of a corresponding layer along a substantially straight line.

9. The medical device of claim 8, wherein each customized facet of each layer of customized facets intersects a customized facet of another layer along a substantially straight line.

10. The medical device of claim 9, wherein each customized facet includes a substantially planar inner surface.

11. The medical device of claim 1, further comprising:

a frame connecting the radiant heater to the patient support, the frame including a vertical arm that supports the radiant heater above the patient support, and an angle is defined between the vertical arm and the patient support, the angle having a magnitude in a range between 89 degrees and 93.5 degrees.

12. The medical device of claim 1, wherein:

the asymmetric reflector includes an outer rim, and an angle is defined between a plane defined by the outer rim and a horizontal plane, the angle having a magnitude in a range between 19.5 degrees and 24 degrees.

13. The medical device of claim 12, wherein a vertical distance is defined between a lower section of the asymmetric reflector and the patient support, the vertical distance being in a range of 29 and 34 inches.

14. The medical device of claim 1, wherein the number of layers of customized facets further includes a second layer having a third front-rear center line extending from the front end to the rear end of the second layer, wherein the central axis of the infrared heating element extends through a third reference point on the third front-rear center line of the second layer, and wherein the third reference point is positioned on the third front-rear center line equidistant from the front and rear ends of the second layer.

15. The medical device of claim 14, wherein a distance between the front and rear ends of the first layer along the second front-rear center line is greater than a distance between front and rear ends of the second layer along the third front-rear center line.

16. The medical device of claim 14, wherein the number of layers of customized facets further includes a third layer having a fourth front-rear center line extending from the front end to the rear end of the third layer, wherein the central axis of the infrared heating element extends through a fourth reference point on the fourth front-rear center line of the third layer, and wherein the fourth reference point is positioned a third distance from the front end of the third layer and a fourth distance from the rear end of the third layer that is different from the third distance.

17. The medical device of claim 16, wherein a distance between the front and rear ends of the third layer along the fourth front-rear center line is (i) greater than a distance between front and rear ends of the second layer along the third front-rear center line and (ii) less than a distance between the front and rear ends of the first layer along the second front-rear center line.

18. A medical device for infant care, the medical device comprising:

a patient support sized to receive a body of an infant, and a radiant heater positioned above the patient support, the radiant heater comprising:

an infrared heating element having a central axis and operable to emit radiant energy, and a reflector that partially surrounds the infrared heating element to direct radiant energy emitted by the infrared heating element toward a predefined region of the patient support to maintain the predefined region at a predetermined temperature, wherein the reflector comprises an outer rim, a first plurality of customized facets, and a second plurality of customized facets, wherein each customized facet of the first and second pluralities of customized facets has a reflective surface that faces the infrared heating element, wherein, in a first cross-section of the reflector extending through the central axis of the infrared heating element: (i) the reflective surfaces of the first plurality of customized facets are symmetrical about the central axis, and (ii) the reflective surfaces of the second plurality of customized facets are asymmetrical about the central axis.

19. The medical device of claim 18, wherein second plurality of customized facets is positioned between the first plurality of customized facets and the outer rim.

20. The medical device of claim 18, wherein, in a second cross-section of the reflector extending through the central axis of the infrared heating element: (i) the reflective surfaces of the first plurality of customized facets are symmetrical about the central axis, and (ii) the reflective surfaces of the second plurality of customized facets are symmetrical about the central axis.

* * * * *